US008857354B2

(12) United States Patent
Sakuma et al.

(10) Patent No.: US 8,857,354 B2
(45) Date of Patent: Oct. 14, 2014

(54) GAS CARRYING THREADING DEVICE OF SEWING MACHINE

(75) Inventors: Kouichi Sakuma, Yamagata (JP); Masato Ishikawa, Yamagata (JP); Mitsuru Satou, Yamagata (JP)

(73) Assignee: Suzuki Manufacturing, Ltd., Yamagata (JP)

( * ) Notice: Subject to any disclaimer, the term of this patent is extended or adjusted under 35 U.S.C. 154(b) by 0 days.

(21) Appl. No.: 14/003,242

(22) PCT Filed: Nov. 10, 2011

(86) PCT No.: PCT/JP2011/075977

§ 371 (c)(1),
(2), (4) Date: Sep. 5, 2013

(87) PCT Pub. No.: WO2012/172704

PCT Pub. Date: Dec. 20, 2012

(65) Prior Publication Data

US 2014/0083344 A1 Mar. 27, 2014

(30) Foreign Application Priority Data

Jun. 16, 2011 (JP) ..... 2011-134390

(51) Int. Cl.

| | |
|---|---|
| ***D05B 57/02*** | (2006.01) |
| ***D05B 57/34*** | (2006.01) |
| ***D05B 63/02*** | (2006.01) |
| ***D05B 87/00*** | (2006.01) |

(52) U.S. Cl.

CPC ..... *D05B 57/34* (2013.01); *D05D 2207/04* (2013.01); *D05B 63/02* (2013.01); *D05B 87/00* (2013.01)

USPC ..... 112/302; 112/199

(58) Field of Classification Search

CPC ..... D04B 57/00; D04B 57/02; D04B 57/12; D04B 87/00; D04B 87/02; D04B 87/04

USPC ..... 112/192, 199, 165, 166, 194, 197, 220, 112/302

See application file for complete search history.

(56) References Cited

U.S. PATENT DOCUMENTS 4,198,915 A * 4/1980 Peterson et al. ..... 112/225
5,327,841 A * 7/1994 Sakuma ..... 112/162

(Continued)

FOREIGN PATENT DOCUMENTS

JP 2865470 B2 3/1999
JP 3355214 B2 9/2002

(Continued)

OTHER PUBLICATIONS

PCT/JP2011/075977 International Search Report Dated Feb. 14, 2012.

*Primary Examiner* — Danny Worrell, Jr.
(74) *Attorney, Agent, or Firm* — Howard & Howard Attorneys PLLC

(57) ABSTRACT

A threading to a looper is performed with one-touch operation. A looper threading/sewing changeover mechanism 30 including a push button 33 for a pressing operation of a push button shaft 32 that a control pin 31 is protruded and provided, a control groove cam 38 which includes a first control groove cam portion 34—a fourth control groove cam portion 37 which receive the control pin, a connecting movement plate 40 which supports a thread guide portion and which is elastically repelled toward a threading state that a thread guide outlet of the thread guide portion contacts to a looper thread inlet of the looper by a first spring 39, and a connecting positioning plate 82 which rotates together with a main shaft 2 integrally and has a peripheral surface 80 that a tip portion 41 of the push button shaft contacts and has a notch portion 81 that the tip portion of the push button shaft is fitted is provided.

10 Claims, 10 Drawing Sheets

(56) References Cited

U.S. PATENT DOCUMENTS

| | | | | |
|---|---|---|---|---|
| 7,523,712 | B2 * | 4/2009 | Sadasue | 112/302 |
| 7,536,964 | B2 * | 5/2009 | Sadasue | 112/302 |
| 2008/0134950 | A1 * | 6/2008 | Sadasue | 112/201 |
| 2008/0236466 | A1 * | 10/2008 | Sadasue | 112/302 |
| 2008/0257241 | A1 * | 10/2008 | Sadasue | 112/225 |
| 2012/0210922 | A1 | 8/2012 | Sakuma et al. | |

FOREIGN PATENT DOCUMENTS

| | | | |
|---|---|---|---|
| JP | 4088504 | B2 | 5/2008 |
| JP | 2008119361 | A | 5/2008 |
| JP | 2008237551 | A | 10/2008 |
| JP | 201162501 | | 3/2011 |

* cited by examiner

GAS CARRYING THREADING DEVICE OF SEWING MACHINE

FIELD OF THE ART

The present invention relates to a gas carrying threading device of sewing machine, particularly relates to the gas carrying threading device of sewing machine such as a serger, a double chain stitch sewing machine, or a cover stitch sewing machine for performing a threading of a looper thread automatically to a looper by utilizing a pressurized gas.

BACKGROUND OF THE ART

Conventionally, in the serger, the double chain stitch sewing machine, or the cover stitch sewing machine, etc., the gas carrying threading device which is connected by a hollow looper thread guide which leads to a looper thread guide outlet of a loop-taker point of the looper from a thread introduction portion which inserts the looper thread and which feeds a looper thread by utilizing a flow of a pressurized gas which is supplied to the hollow looper thread guide is known. Hereby, a complicated thread guard is unnecessary and a threading that a handleability is easy can be performed. Therefore, there are no mistake of the threading, no protrusion of the looper thread in mid-process, and no entanglement of the inserted looper thread with other thread, and thereby the threading can be performed at once by the extremely easy operation (Patent document No. 1-No. 3).

In a structure of the foregoing gas carrying threading, a pathway for the threading becomes considerably simple, and an operation of the threading becomes easy, and an entanglement of the thread or an incidence of a thread breakage can be dissolved.

However, in the structure of the foregoing gas carrying threading, while pressing a stopper shaft (positioning pin) for a connecting positioning plate by one hand, a pulley is rotated manually by the other hand, and thereby a stitch forming device must be locked and concurrently a threading connecting device must be connected. Therefore, it is difficult to understand how to use this threading device for the operator who is not familiar with the sewing machine, and an insertion operation of the looper thread which is performed by using both hands concurrently is considerably complex, thereby the training of that purpose is necessary.

Then, a looper threading device which inserts the looper thread to the looper by several operations by one hand without using both hands concurrently and attempts an easy threading operation is proposed (Patent document No. 4-No. 5).

PRIOR ART DOCUMENT

Patent Document

[Patent document No. 1] JP-2865470-B2
[Patent document No. 2] JP-3355214-B2
[Patent document No. 3] JP-4088504-B2
[Patent document No. 4] JP-2008-119361-A (FIG. 2)
[Patent document No. 5] JP-2011-62501-A

SUMMARY OF THE INVENTION

Problem to be Solved by the Invention

In the looper threading device which is disclosed in Patent Document No. 5, because the looper thread can be inserted to the looper by one-handed operation of only three times by using a looper threading/stitch forming changeover manual lever, it is very efficient as the looper threading device.

However, although the looper threading device which is disclosed in Patent Document No. 4 performs the threading of the looper by using the structure of a push button which is disclosed in Patent Document No. 1-No. 2 unlike the looper threading device which is disclosed in Patent Document No. 5, there are following serious disadvantages.

(1) As the difficult point in the mechanism, (a) Because a looper (looper support member), a looper drive arm and a thread pass tube looper thread guide plate are composed as a conglomerate which gather separately, a looper drive at the time of sewing and a changeover mechanism at the time of looper threading become complicated (FIG. 3).

(b) Because a looper take-up lever does not intervene in a looper threading route to a thread insertion opening from a thread groove, it is necessary to consider a looper take-up lever mechanism separately (FIG. 1, FIG. 5, FIG. 13).

(2) As the difficult point in the operation, (a) Essentially, the looper threading is intended to perform the threading of the looper thread which is drawn out from a thread spool to a looper loop-taker point thread outlet directly. However originally, the operation which guides the looper thread which is drawn out from the thread spool from the thread groove to the thread insertion opening is extremely complicated in the looper threading device which is disclosed in Patent Document No. 4 (FIG. 1).

(b) The looper threading device which is disclosed in Patent Document No. 4 is intended to attempt the easy operation of the threading because the threading operation is considerably simplified. However, practically, one-handed operation of four times of an operation for movement of operation lever, an operation for rotation of positioning of flywheel, a pressing operation of a lock button and an operation for starting of air spraying are indeed necessary. Therefore, the effect that the threading operation is considerably simplified and the easy operation of the threading is attempted cannot be achieved. Further, heretofore, a problem to have to insert directly a tip of a lower thread to the thread insertion opening 111 of the looper which is assumed to be complicated remains (FIG. 1, FIG. 13).

The present invention was conducted to solve these difficult points. The object of the present invention is to provide the gas carrying threading device of sewing machine which is simplified on the mechanism and is able to perform the threading more easily with one-touch operation to the looper by one-handed operation of small number of times on the operation.

Means for Solving the Problems

In order to achieve such the object, a gas carrying threading device of sewing machine of the present invention comprises at least one looper having a hollow structure from a looper thread inlet to a looper loop-taker point thread outlet, a thread introduction portion inserting a looper thread which is led to the looper, a hollow thread guide portion having a thread guide outlet which connects to the thread introduction portion and performs a contact/separation for the looper thread inlet of the looper, a connecting portion moving the thread guide portion between a threading state that the thread guide outlet of the thread guide portion contacts to the looper thread inlet of the looper and a sewing state that the thread guide outlet of the thread guide portion separates from the looper thread inlet of the looper, and a gas supply portion feeding the looper thread from the thread introduction portion to the looper loop-taker point thread outlet through the looper when the thread guide portion is moved to the threading state. Further, when moving the connecting portion to contact and separate the thread guide outlet of the thread guide portion and the looper thread inlet of the looper freely, a gas carrying threading device of sewing machine of the present invention comprises a looper threading/sewing changeover mechanism including a push button for a pressing operation of a push button shaft which protrudes a control pin, a control groove cam which includes a first control groove cam portion, a second control groove cam portion and a third control groove cam portion which receive the control pin, a connecting movement plate which supports the thread guide portion and which is elastically repelled toward the threading state that the thread guide outlet of the thread guide portion contacts to the looper thread inlet of the looper by a first spring, and a connecting positioning plate rotating together with a main shaft integrally and having a peripheral surface that a tip portion of the push button shaft contacts and having a notch portion that the tip portion of the push button shaft is fitted. The looper threading/sewing changeover mechanism comprises a sewing state holding position which latches together the control pin at the first control groove cam portion at the time of a non-pressing operation of the push button and holds the sewing state, a threading preparatory state holding position which latches together the control pin at the second control groove cam portion at the time of a pressing operation of the push button, contacts the tip portion of the push button shaft to a peripheral surface of the connecting positioning plate and holds the connecting movement plate in a threading preparatory state, and a threading state holding position which fits the tip portion of the push button shaft into the notch portion of the connecting positioning plate by rotating the main shaft manually, fits loosely the control pin into the third control groove cam portion and holds the threading state.

In the gas carrying threading device of sewing machine of the present invention, the push button shaft includes the push-button, and a set shaft which juxtaposes a large diameter portion and a small diameter portion and a stopper shaft which protrudes the control pin and includes the tip portion are connected in a nested state, and a second spring is intervened between both.

In the gas carrying threading device of sewing machine of the present invention, the connecting movement plate has a holding portion and a slide portion which holds and slides a large diameter portion and a small diameter portion respectively which are juxtaposed at the set shaft, and is connected with the control groove cam which receives the control pin which is protruded from the stopper shaft so that both can move together freely.

According to the gas carrying threading device of sewing machine of the present invention, in the sewing state holding position, the set shaft of the push button shaft is held by latching together the large diameter portion of the set shaft in the holding portion of the connecting movement plate and contacting the contact retaining piece which is provided at the large diameter portion of the set shaft to the connecting movement plate by an elastic repulsion of the second spring, and the stopper shaft of the push button shaft is held by engaging the control pin which protrudes from the stopper shaft in the first control groove cam portion of the control groove cam. In the threading preparatory state holding position, the set shaft of the push button shaft is held by engaging the control pin which protrudes from the stopper shaft in the second control groove cam portion of the control groove cam, and the stopper shaft of the push button shaft is held by contacting the tip portion of the stopper shaft to a peripheral surface of the connecting positioning plate. And, in the threading state holding position, the set shaft of the push button shaft is held by latching together the small diameter portion of the set shaft at the one end of the slide portion of the connecting movement plate, and the stopper shaft of the push button shaft is held by fitting the tip portion of the stopper shaft into the notch portion of the connecting positioning plate.

In the gas carrying threading device of sewing machine of the present invention, after completing a threading to the looper, when returning the connecting movement plate from the threading state to the sewing state manually and forcibly, the connecting movement plate has a return lever that the control pin slides in a fourth control groove cam portion of the control groove cam and latches together at the first control groove cam portion and holds the sewing state.

In the control groove cam of the gas carrying threading device of sewing machine of the present invention, the first control groove cam portion which latches together the control pin at the time of a non-pressing operation of the push button and holds the sewing state continues to the fourth control groove cam portion and the second control groove cam portion and has an U-shape groove cam structure. The second control groove cam portion which latches together the control pin at the time of a pressing operation of the push button and holds the connecting movement plate in the threading preparatory state by contacting the tip portion of the push button shaft to a peripheral surface of the connecting positioning plate continues to the first control groove cam portion and the third control groove cam portion and has a step-like groove cam structure. The third control groove cam portion which latches together the control pin by rotating the main shaft manually and holds the threading state by fitting the tip portion of the push button shaft into the notch portion of the connecting positioning plate continues to the second control groove cam portion and the fourth control groove cam portion and has an U-shape groove cam structure. And the fourth control groove cam portion which returns the connecting movement plate from the threading state to the sewing state manually and forcibly continues to the third control groove cam portion and the first control groove cam portion and has a slanted groove cam structure that the control pin slides.

In the gas carrying threading device of sewing machine of the present invention, a safety device which prohibits the power supply of a motor which drives the main shaft depending on a position of the connecting movement plate is provided when the connecting movement plate is held in the threading preparatory state and the threading state by a pressing operation of the push button.

The gas carrying threading device of sewing machine of the present invention comprises at least one looper having a hollow structure from a looper thread inlet to a looper loop-taker point thread outlet, a thread introduction portion inserting a looper thread which is led to the looper, a hollow thread guide portion having a thread guide outlet which connects to the thread introduction portion and performs a contact/separation for the looper thread inlet of the looper, a connecting portion moving the thread guide portion between a threading state that the thread guide outlet of the thread guide portion contacts to the looper thread inlet of the looper and a sewing state that the thread guide outlet of the thread guide portion separates from the looper thread inlet of the looper, and a gas supply portion feeding the looper thread from the thread introduction portion to the looper loop-taker point thread outlet through the looper when the thread guide portion is moved to the threading state. Further, when moving the connecting portion to contact and separate the thread guide outlet of the thread guide portion and the looper thread inlet of the looper freely, a gas carrying threading device of sewing machine of the present invention comprises a looper threading/sewing changeover mechanism including a push button for a pressing operation of a push button shaft which protrudes a control pin, a control groove cam which includes plural control groove cam portions which receive the control pin, a connecting movement plate which supports the thread guide portion and which is elastically repelled toward the threading state that the thread guide outlet of the thread guide portion contacts to the looper thread inlet of the looper by a first spring, and a connecting positioning plate rotating together with a main shaft integrally and having a peripheral surface that a tip portion of the push button shaft contacts and having a notch portion that the tip portion of the push button shaft is fitted. The control groove cam of the looper threading/sewing changeover mechanism comprises a first control groove cam portion which latches together the control pin at the time of a non-pressing operation of the push button and holds the sewing state, a second control groove cam portion which is latched together at the control pin at the time of a pressing operation of the push button and holds the connecting movement plate in a threading preparatory state by contacting the tip portion of the push button shaft to a peripheral surface of the connecting positioning plate, a third control groove cam portion that the control pin is loosely fitted by rotating the main shaft manually and holds the threading state by fitting the tip portion of the push button shaft into the notch portion of the connecting positioning plate, and a fourth control groove cam portion which slides the control pin and holds the sewing state by latching together at the first control groove cam portion when returning the connecting movement plate from the threading state to the sewing state manually and forcibly after completing a threading to the looper.

The gas carrying threading device of sewing machine of the present invention comprises at least one looper having a hollow structure from a looper thread inlet to a looper loop-taker point thread outlet, a thread introduction portion inserting a looper thread which is led to the looper, a hollow thread guide portion having a thread guide outlet which connects to the thread introduction portion and performs a contact/separation for the looper thread inlet of the looper, a connecting portion moving the thread guide portion between a threading state that the thread guide outlet of the thread guide portion contacts to the looper thread inlet of the looper and a sewing state that the thread guide outlet of the thread guide portion separates from the looper thread inlet of the looper, and a gas supply portion feeding the looper thread from the thread introduction portion to the looper loop-taker point thread outlet through the looper when the thread guide portion is moved to the threading state. Further, when moving the connecting portion to contact and separate the thread guide outlet of the thread guide portion and the looper thread inlet of the looper freely, the gas carrying threading device of sewing machine of the present invention comprises a looper threading/sewing changeover mechanism including a push button for a pressing operation of a push button shaft which protrudes a control pin, a control groove cam which includes plural control groove cam portions which receive the control pin, a connecting movement plate which supports the thread guide portion and which is elastically repelled toward the threading state that the thread guide outlet of the thread guide portion contacts to the looper thread inlet of the looper by a first spring, and a connecting positioning plate which rotates together with a main shaft integrally and has a peripheral surface that a tip portion of the push button shaft contacts and has a notch portion that the tip portion of the push button shaft is fitted. The looper threading/sewing changeover mechanism comprises a threading preparatory function which holds the connecting movement plate from the sewing state to the threading preparatory state through a control groove cam which engages to the control pin by pressing the push button shaft by the push button and contacts the tip portion of the push button shaft to a peripheral surface of the connecting positioning plate which rotates together with the main shaft integrally, a threading function which fits the tip portion into the notch portion of the connecting positioning plate by rotating the main shaft manually and holds the threading state, and a return function which holds the sewing state through the control groove cam which slides at the control pin when returning the connecting movement plate from the threading state to the sewing state manually and forcibly after completing a threading to the looper.

Effect of the Invention

According to the gas carrying threading device of sewing machine of the present invention, the looper threading can be performed by one-handed three operations which are a threading preparatory operation, a threading positioning/connecting pulley operation and a threading gas supply operation.

Therefore, according to the gas carrying threading device of sewing machine of the present invention, by connecting with the hollow thread guide portion which leads to the thread introduction portion which inserts the thread from the thread outlet of the loop-taker point of the looper, the complicated thread guard is unnecessary and the threading that the handleability is easy can be performed. And, there are no mistake of the threading, no protrusion of the looper thread in mid-process, and no entanglement of the inserted looper thread with other thread. Besides, because the looper thread is fed by utilizing the flow of the pressurized gas which is supplied to the hollow thread guide portion, the threading can be performed at once by the extremely easy operation.

Besides, according to the gas carrying threading device of sewing machine of the present invention, because the safety device works depending on a movement position of the connecting movement plate and the power source to a sewing machine motor is disconnected, a breakage of the serger by such as incorrect operation to a motor controller during the threading preparatory operation and a completion of the threading can be prevented.

BRIEF DESCRIPTION OF THE DRAWINGS

FIG. 3 (B) A partial exploded perspective view in a threading state of a gas carrying threading device of sewing machine by the present invention.

MODE FOR CARRYING OUT THE INVENTION

Figure 1:
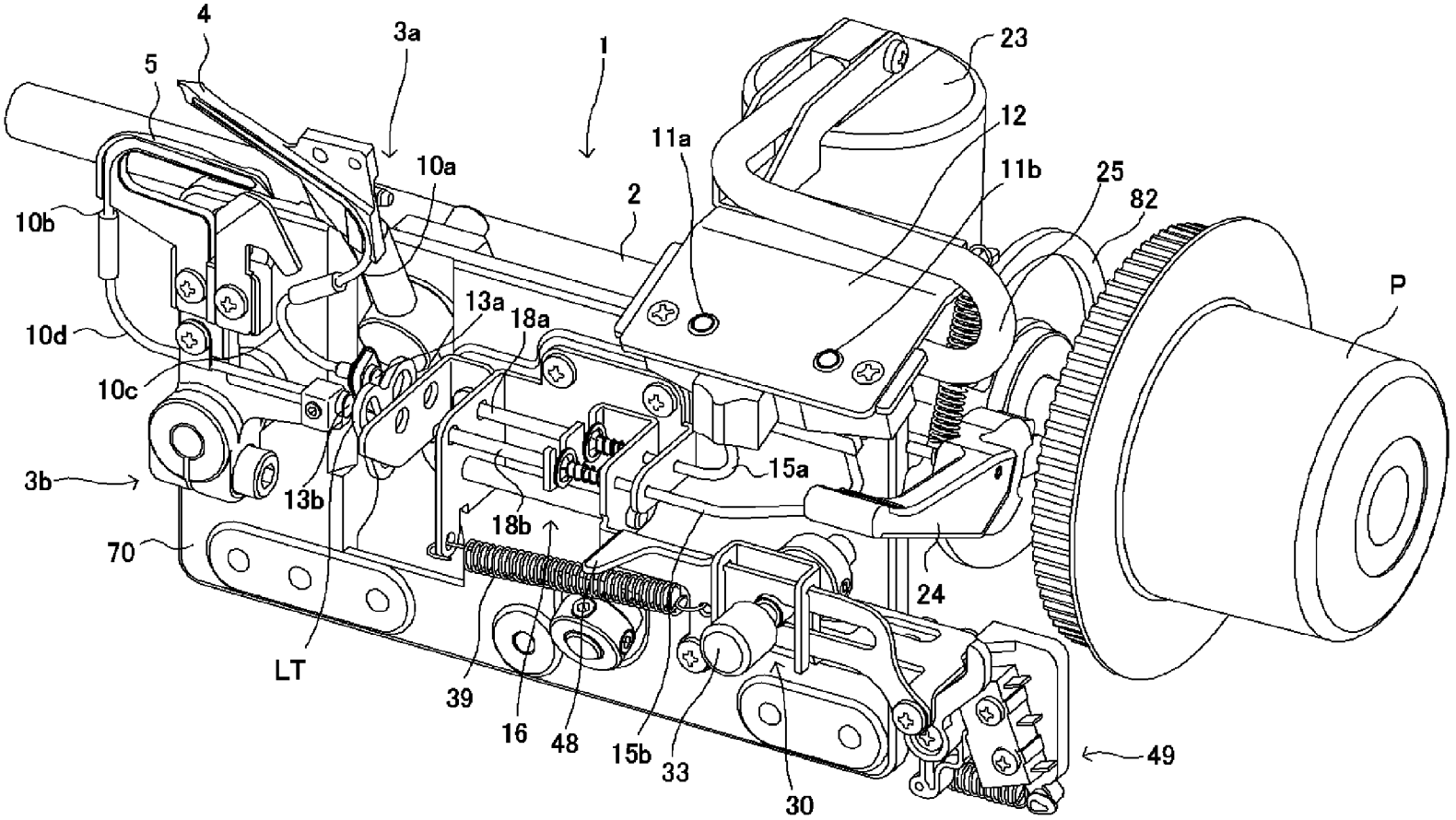
FIG. 1A whole perspective view seeing a gas carrying threading device of sewing machine by the present invention from a right side of a front side of a sewing machine.

Hereinafter, the preferable embodiment that the gas carrying threading device of sewing machine of the present invention is applied to the serger is explained in detail by referring to the drawings.

Figure 9:
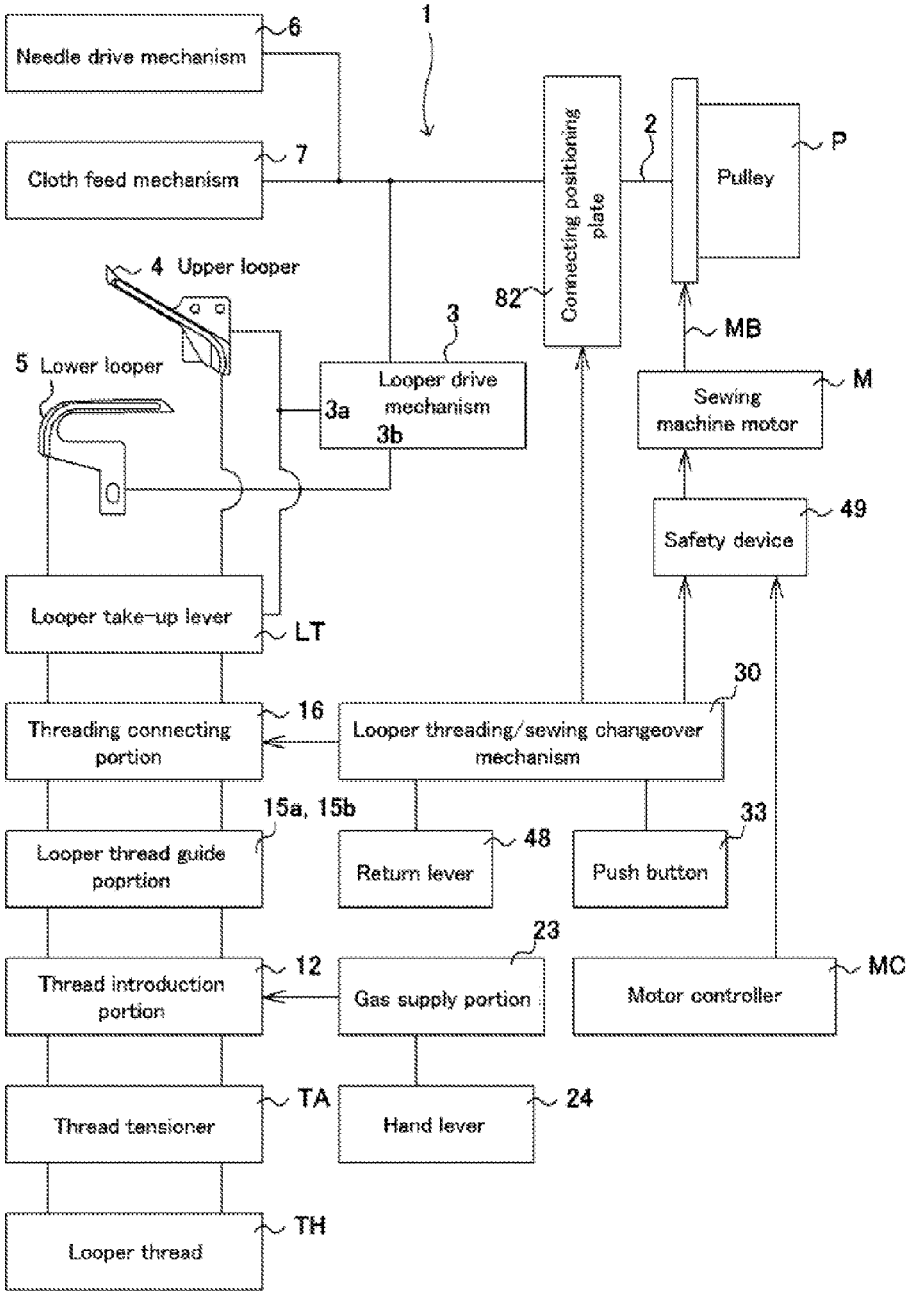
FIG. 9 A block diagram of a gas carrying threading device of sewing machine by the present invention.

As shown in FIG. 1 and FIG. 9, the serger 1 is composed from a main frame and a sub-frame which form a bed and an arm.

The sewing machine motor M is attached to the sub-frame, and a main shaft 2 lengthens along the frame in a horizontal direction. The main shaft 2 is rotated and driven by using a timing belt MB by the sewing machine motor M.

The stitch forming device is composed by the upper looper 4 and lower looper 5 which are driven by the looper drive mechanism 3 (3*a*, 3*b*) by synchronizing to the main shaft 2, the needle which is driven by the needle drive mechanism 6, a presser foot mechanism which presses a cloth on a throat plate and a cloth feed mechanism 7 which forwards the cloth every one stitch. In addition, because the concrete structure and the motion are public known or well-known (Patent Document No. 1-3, 5), the detailed explanation is omitted and the illustrations of the needle, the throat plate and the presser foot mechanism are also omitted.

<Threading/Thread Pass Mechanism>

Figure 4:
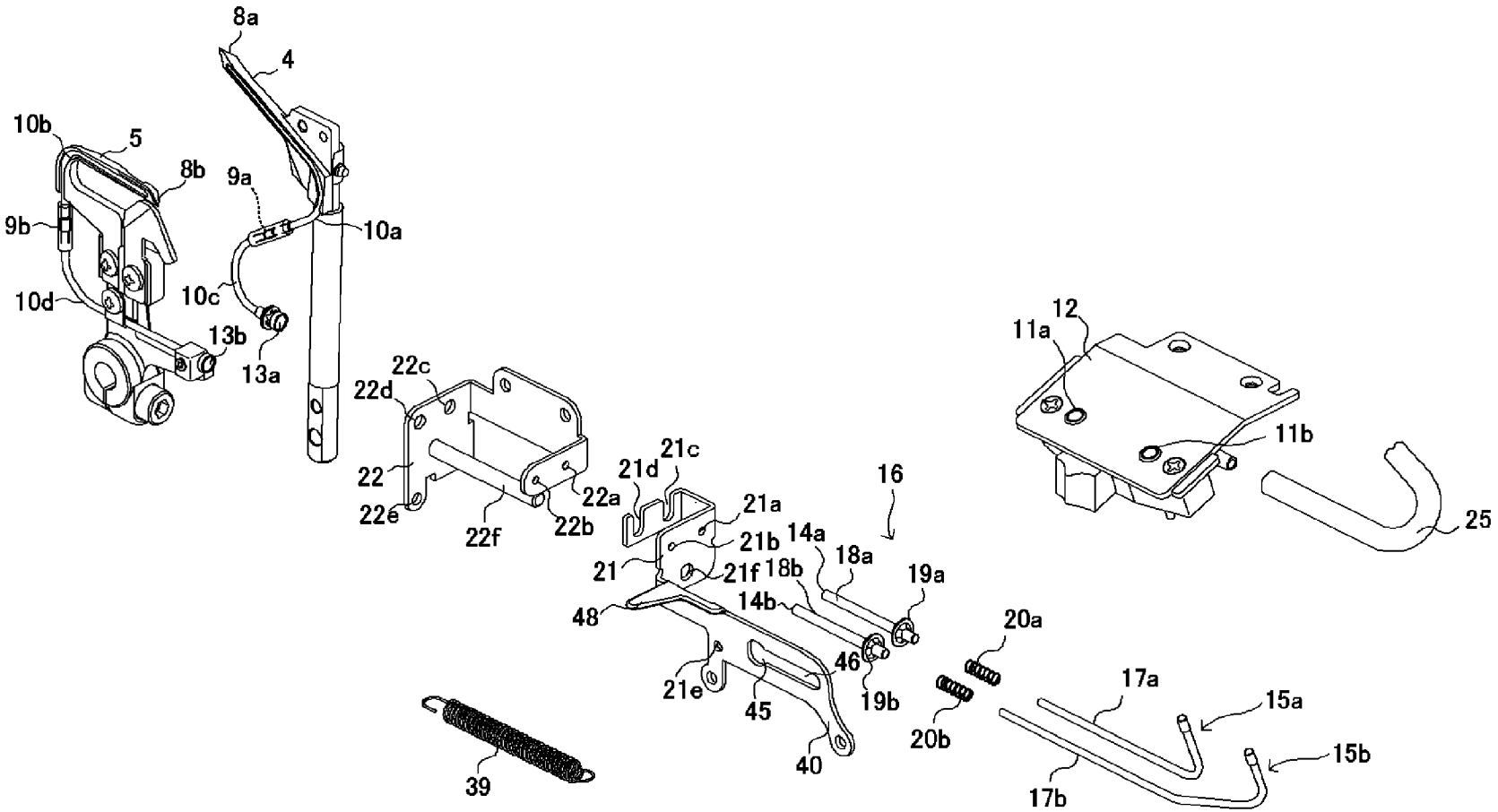
FIG. 4 An exploded perspective view of the thread guide portion which is connected to the thread introduction portion of a gas carrying threading device of sewing machine by the present invention and which performs a contact/separation for the looper thread inlet of the looper.
Figure 5:
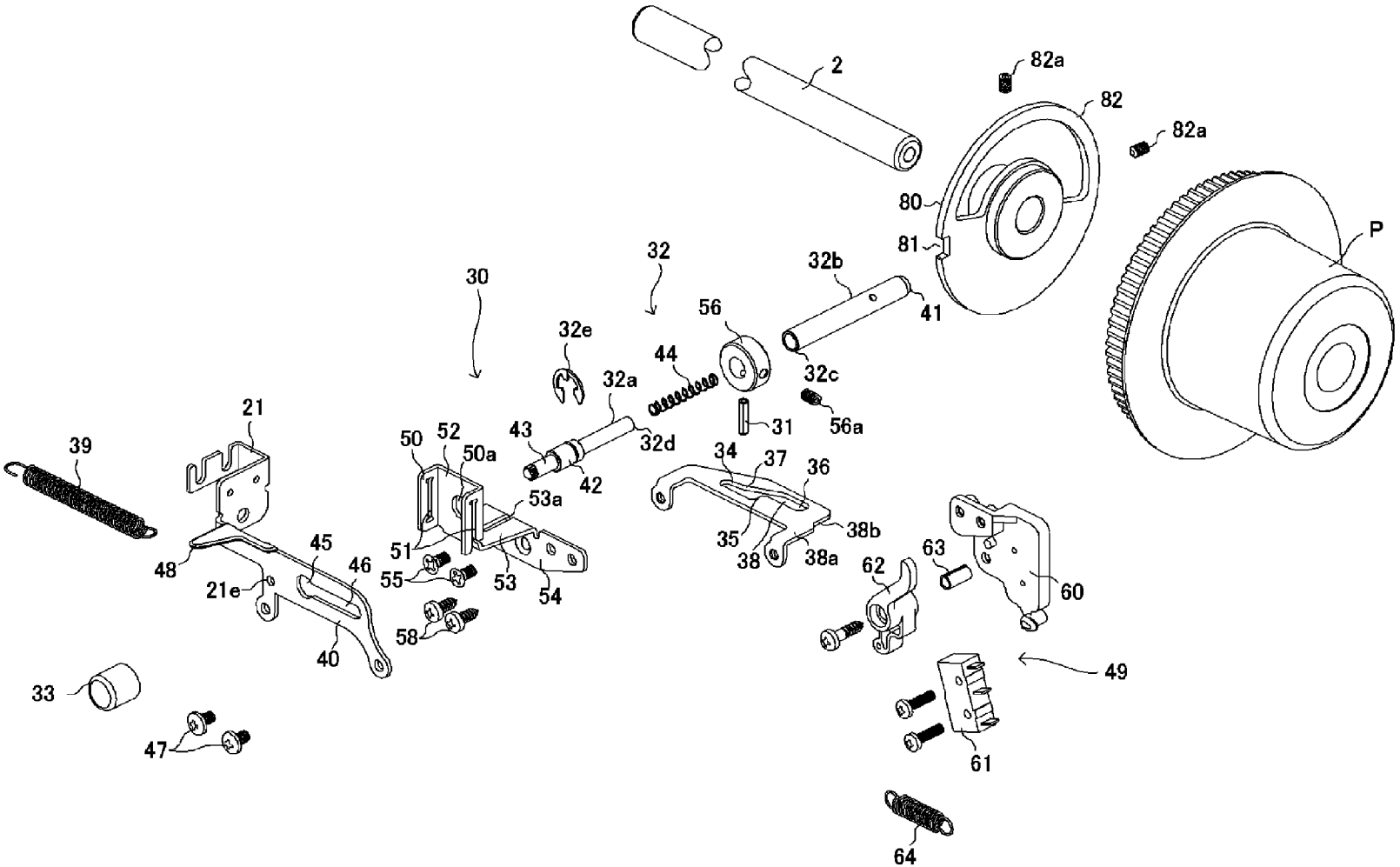
FIG. 5 An exploded perspective view of the looper threading/sewing changeover mechanism of a gas carrying threading device of sewing machine by the present invention.

In the gas carrying threading device of sewing machine of the present invention, the upper looper 4 and the lower looper 5 are the hollow structure from the looper thread inlet 9*a*, 9*b* to the looper loop-taker point thread outlet 8*a*, 8*b* (FIG. 4). Here, "hollow structure" may compose the looper itself as the hollow structure from the looper thread inlet 9*a*, 9*b* to the looper loop-taker point thread outlet 8*a*, 8*b*, and may compose the structure that a groove is formed in the looper from the looper thread inlet 9*a*, 9*b* to the looper loop-taker point thread outlet 8*a*, 8*b*, and that a hollow pipe is embedded in there. In this case, a cross-section of the structure may be a circle or a polygon, and for example, the cross-section may be C-shape that a part lacks. In the example of the illustration, as the hollow structure, the groove is formed in the upper looper 4 and the lower looper 5, and a conduit (hollow pipe) 10*a*, 10*b* which is embedded in there and a conduit 10*c*, 10*d* which is connected to the looper thread inlet 13*a*, 13*b* is used.

The thread introduction portion 12 which inserts the looper thread TH which is drawn out from the thread spool from thread insertion opening 11*a*, 11*b* and leads to the upper looper 4 and the lower looper 5 is provided.

The thread introduction portion 12 is connected to the hollow thread guide portion (conduit=hollow pipe) 15*a*, 15*b* which has the thread guide outlet 14*a*, 14*b* that the contact/separation is performed for the looper thread inlet 13*a*, 13*b* of the upper looper 4 and the lower looper 5.

The connecting portion 16 which moves the thread guide portion 15*a*, 15*b* between the threading state that the thread guide outlet 14*a*, 14*b* of the thread guide portion 15*a*, 15*b* contacts to the looper thread inlet 13*a*, 13*b* of the upper looper 4 and the lower looper 5 and the sewing state that the thread guide outlet 14*a*, 14*b* of the thread guide portion 15*a*, 15*b* separates from the looper thread inlet 13*a*, 13*b* of the upper looper 4 and the lower looper 5 is provided. In the connecting portion 16, the thread guide portion 15*a*, 15*b* is divided into a fixed thread guide portion (conduit=hollow pipe) 17*a*, 17*b* and a movable thread guide portion (conduit=hollow pipe) 18*a*, 18*b* which has a flange 19*a*, 19*b*, and both are connected in the nested state through a spring 20*a*, 20*b* and are supported by a supporting portion 21 which is fixed to the connecting movement plate 40, and a guide hole 21*f* which is provided at this supporting portion 21 is slidably attached at a guide shaft 22*f* of a guide plate 22 which is fixed at a looper base 70. The fixed thread guide portion 17*a*, 17*b* is guided by a passage hole 22*a*, 22*b* of the guide plate 22, and is guided by a passage hole 21*a*, 21*b* of the supporting portion 21, and is fitted into the movable thread guide portion 18*a*, 18*b* in the nested state. The movable thread guide portion 18*a*, 18*b* is supported by a U-shaped groove 21*c*, 21*d* for passage of the supporting portion 21, and is guided by a passage hole 22*c*, 22*d* of the guide plate 22, and lengthens toward the looper thread inlet 13*a*, 13*b* of the upper looper 4 and the lower looper 5. The flange 19*a*, 19*b* is biased together with the movable thread guide portion 18*a*, 18*b* to the side of the U-shaped groove 21*c*, 21*d* for passage by the elastic repulsion of the spring 20*a*, 20*b*. The spring 20*a*, 20*b* has also the buffer function when the thread guide outlet 14*a*, 14*b* of the thread guide portion 15*a*, 15*b* contacts to the looper thread inlet 13*a*, 13*b* of the upper looper 4 and the lower looper 5. In this way, in the connecting portion 16, as mentioned below, depending on the movement of the connecting movement plate 40, the looper thread inlet 13*a*, 13*b* of the upper looper 4 and the lower looper 5 and the thread guide outlet 14*a*, 14*b* of the hollow thread guide portion 15*a*, 15*b* contact or separate (FIG. 2, FIG. 3 (A), FIG. 3 (B), FIG. 4).

Figure 3A:
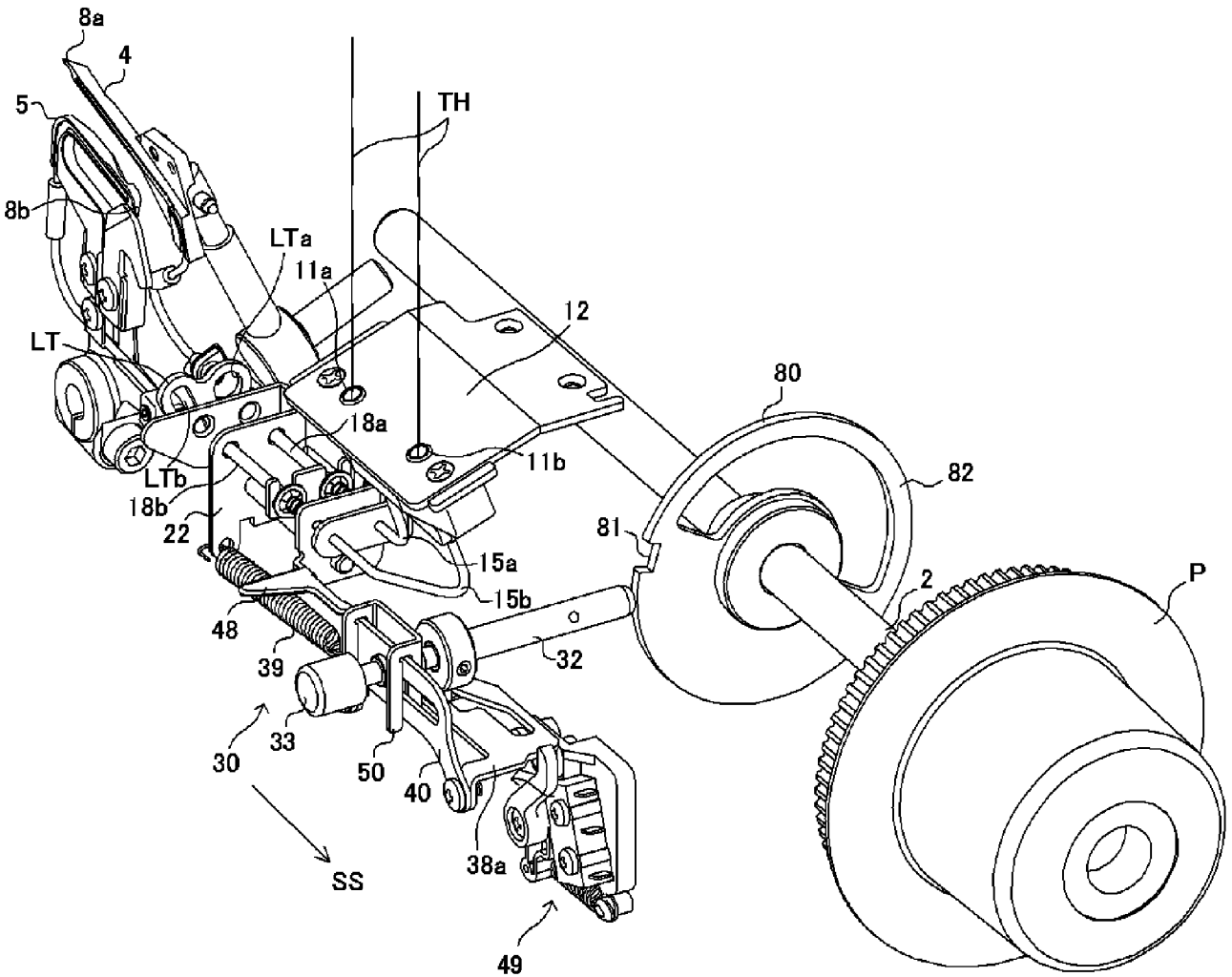
FIG. 3 (A) A partial exploded perspective view in a sewing state of a gas carrying threading device of sewing machine by the present invention.
Figure 3B:
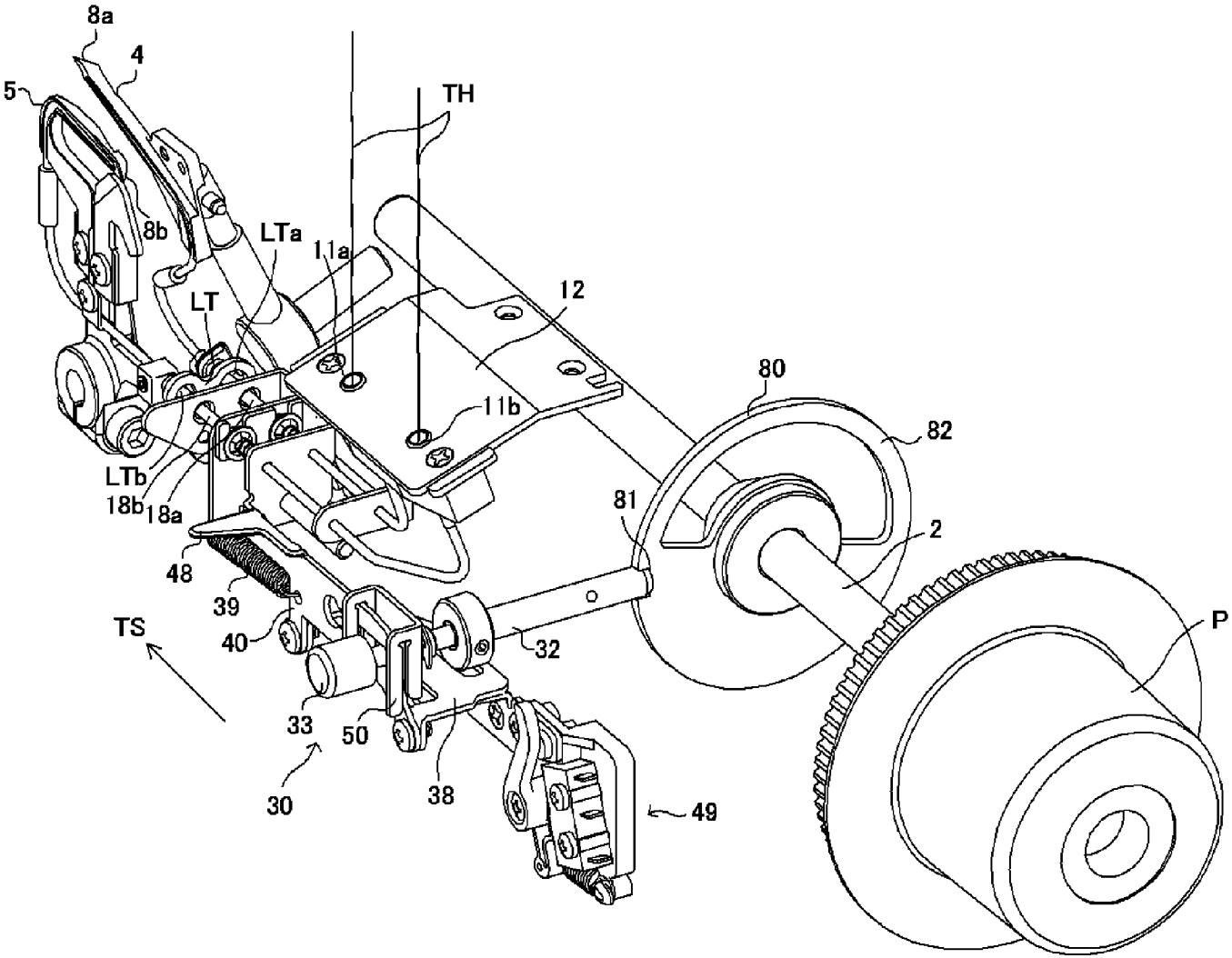

When the thread guide portion 15*a*, 15*b* moves to the threading state (FIG. 3 (B)), the gas supply portion (air pump) 23 which feeds the looper thread TH from the thread introduction portion 12 to the looper loop-taker point thread outlet 8*a*, 8*b* through the upper looper 4 and the lower looper 5 by the gas carrying is provided (FIG. 1). The gas supply portion 23 is driven by a hand lever 24, and the compressed air which is fed from the gas supply portion 23 to the thread introduction portion 12 by the connecting pipe 25 is fed to the inside of the thread pass conduit of the thread guide portion 15*a*, 15*b*, and the looper thread TH is inhaled from the thread insertion opening 11*a*, 11*b* of the thread introduction portion 12 and discharged from the looper loop-taker point thread outlet 8*a*, 8*b* through the thread guide portion 15*a*, 15*b* (fixed thread guide portion 17*a*, 17*b*, movable thread guide portion 18*a*, 18*b*), and through the looper thread inlet 13*a*, 13*b* of the upper looper 4 and the lower looper 5, and thereby the threading is performed. In addition, the concrete structure and the motion of the threading/thread pass mechanism are public known or well-known (Patent Document No. 1-3, 5).

<Looper Threading/Sewing Changeover Mechanism>

As shown in FIG. 1-FIG. 5, when moving the connecting portion 16 to contact and separate the thread guide outlet 14*a*, 14*b* of the thread guide portion 15*a*, 15*b* (movable thread guide portion 18*a*, 18*b*) and the looper thread inlet 13*a*, 13*b* of the upper looper 4 and the lower looper 5 freely, the looper threading/sewing changeover mechanism 30 is provided.

The looper threading/sewing changeover mechanism 30 has the push button 33 for the pressing operation of the push button shaft 32 which protrudes the stopper shaft control pin 31, the control groove cam 38 which is provided at the control groove cam plate 38*a* including the first control groove cam portion 34, the second control groove cam portion 35 and the third control groove cam portion 36 which receive the stopper shaft control pin 31, the connecting movement plate 40 which supports the thread guide portion 15*a*, 15*b* (movable thread guide portion 18*a*, 18*b*) and which is elastically repelled toward the threading state that the thread guide outlet 14*a*, 14*b* of the thread guide portion 15*a*, 15*b* (movable thread guide portion 18*a*, 18*b*) contacts to the looper thread inlet 13*a*, 13*b* of the upper looper 4 and the lower looper 5 by the first spring 39 which is the tension spring, and the connecting positioning plate 82 which rotates together with the main shaft 2 integrally and has the peripheral surface 80 that the tip portion 41 of the push button shaft 32 contacts and the notch portion 81 that the tip portion 41 of the push button shaft 32 is fitted.

The connecting movement plate 40 is biased to the looper side by the first spring 39 which is suspended between the spring stud 21*e* which is provided at the connecting movement plate 40 and the spring stud 22*e* of the guide plate 22.

As shown in FIG. 5-FIG. 8, the looper threading/sewing changeover mechanism 30 has the sewing state holding position SS that the stopper shaft control pin 31 is latched together at the first control groove cam portion 34 at the time of the non-pressing operation of the push button 33 and the sewing state is held, the threading preparatory state holding position RS that the stopper shaft control pin 31 is latched together at the second control groove cam portion 35 at the time of the pressing operation of the push button 33, the tip portion 41 of the push button shaft 32 contacts to the peripheral surface 80 of the connecting positioning plate 82 and the connecting movement plate 40 is held in the threading preparatory state, and the threading state holding position TS that the tip portion 41 of the push button shaft 32 is fitted into the notch portion 81 of the connecting positioning plate 82 by rotating the main shaft 2 manually by the pulley P, the stopper shaft control pin 31 is loosely fitted into the third control groove cam portion 36 and the threading state is held.

In the gas carrying threading device of sewing machine of the present invention, the push button shaft 32 includes the push button 33, and the set shaft 32*a* which juxtaposes the large diameter portion 42 and the small diameter portion 43 which are formed in the center portion of that and the stopper shaft 32*b* which protrudes the stopper shaft control pin 31 and includes the tip portion 41 are connected in the nested state, and the second spring 44 which is the compression spring is intervened between both.

The second spring 44 pushes elastically the stopper shaft 32*b* toward the direction of the main shaft 2 and simultaneously pushes elastically the tip portion of the set shaft 32*a* toward the opposite direction of the main shaft 2 so that the set shaft 32*a* protrudes toward the direction of the front side of the sewing machine.

The tip portion 41 of the stopper shaft 32*b* contacts to the peripheral surface of the connecting positioning plate 82 which is fastened at the main shaft 2 by the screw 82*a*, and is inserted into the notch portion 81 and is engaged. The retaining ring 56 that the stopper shaft control pin 31 is implanted at right angle direction from the center of the stopper shaft 32*b* is fastened by the screw 56*a* at the front end portion that the connecting hole 32*c* of the stopper shaft 32*b* opens. By the retaining ring 56, the stopper shaft control pin 31 engages with the control cam 38 of the cam plate 38*a* which works with the connecting movement plate 40 integrally and penetrates, and further the stopper shaft control pin 31 is fitted loosely to the lower side into the elongate hole 53*a* which is provided at the horizontal arm portion 53 of the set shaft guide plate 50, and these are assembled so that the slide of the axial direction becomes possible while regulating the rotation of the stopper shaft 32*b*.

In the gas carrying threading device of sewing machine of the present invention, the connecting movement plate 40 has the holding portion (circular hole) 45 and the slide portion (elongate hole narrow slit) 46 that the large diameter portion 42 and the small diameter portion 43 which are juxtaposed at the set shaft 32*a* of the push button shaft 32 are respectively held and slid, and is connected with the control groove cam 38 which receives the stopper shaft control pin 31 which protrudes from the stopper shaft 32*b* of the push button shaft 32 by the screw 47 so that both can move together freely. The connecting movement plate 40 connects integrally the control groove cam 38 of the cam plate 38*a* and interlocks it toward the horizontal direction to the looper direction.

The connecting movement plate 40 is supported slidably parallel to the main shaft 2 at a pair of guide hole 51 which are formed from the back plate 52 of the set shaft guide plate 50 toward the set shaft direction. In the set shaft guide plate 50, the back plate 52, the arm 53 and the fixed plate 54 are formed in the crank-shape, and the fixed plate 54 is fastened at the looper base 70 by the screw 55. The push button shaft 32 is fitted into the set shaft hole 49*a* of the looper base 70 and the center support hole 50*a* of the set shaft guide plate 50. Besides, in the set shaft guide plate 50, the elongate hole 53*a* that the stopper shaft control pin 31 is fitted loosely and which slides and controls the stopper shaft 32*b* toward the shaft direction is provided in the horizontal arm 53 which bends in the L-shape from the upper end portion toward the fixed plate 54 of the lower end.

Figure 6:
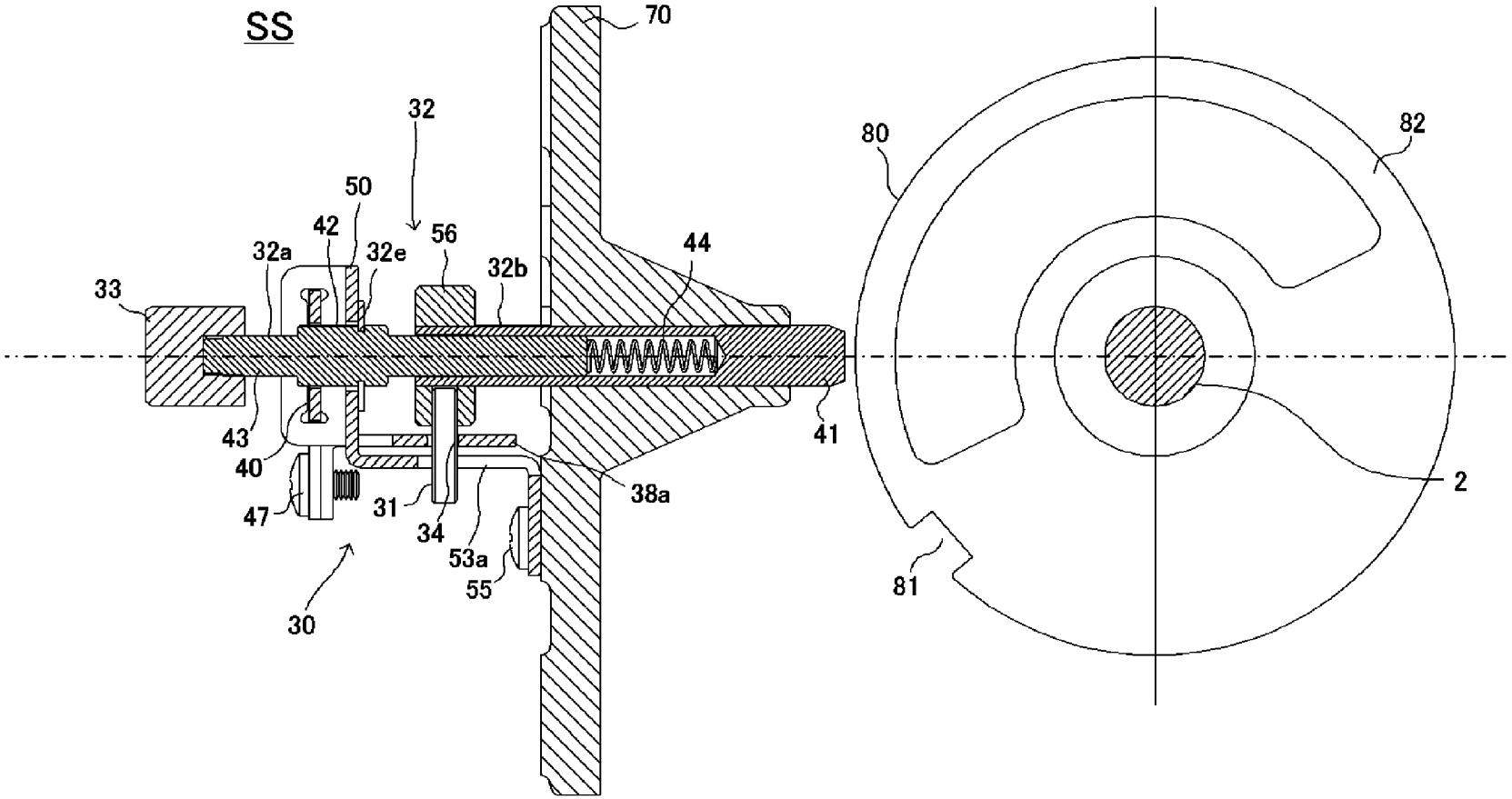
FIG. 6 A sectional explanatory view of the sewing state cutting with a shaft line of a push button shaft in a gas carrying threading device of sewing machine by the present invention.

As shown in FIG. 6, according to the gas carrying threading device of sewing machine of the present invention, in the sewing state holding position SS, the set shaft 32*a* of the push button shaft 32 is held by latching together the large diameter portion 42 of the set shaft 32*a* in the holding portion 45 of the connecting movement plate 40 and contacting the contact retaining piece (E-ring which is fitted into the E-ring groove) 32*e* which is provided at the large diameter portion 42 of the set shaft 32*a* to the set shaft guide plate 50 by the elastic repulsion of the second spring 44, and the stopper shaft 32*b* is held by engaging the stopper shaft control pin 31 which protrudes from the stopper shaft 32*b* in the first control groove cam portion 34 of the control groove cam 38.

Figure 7:
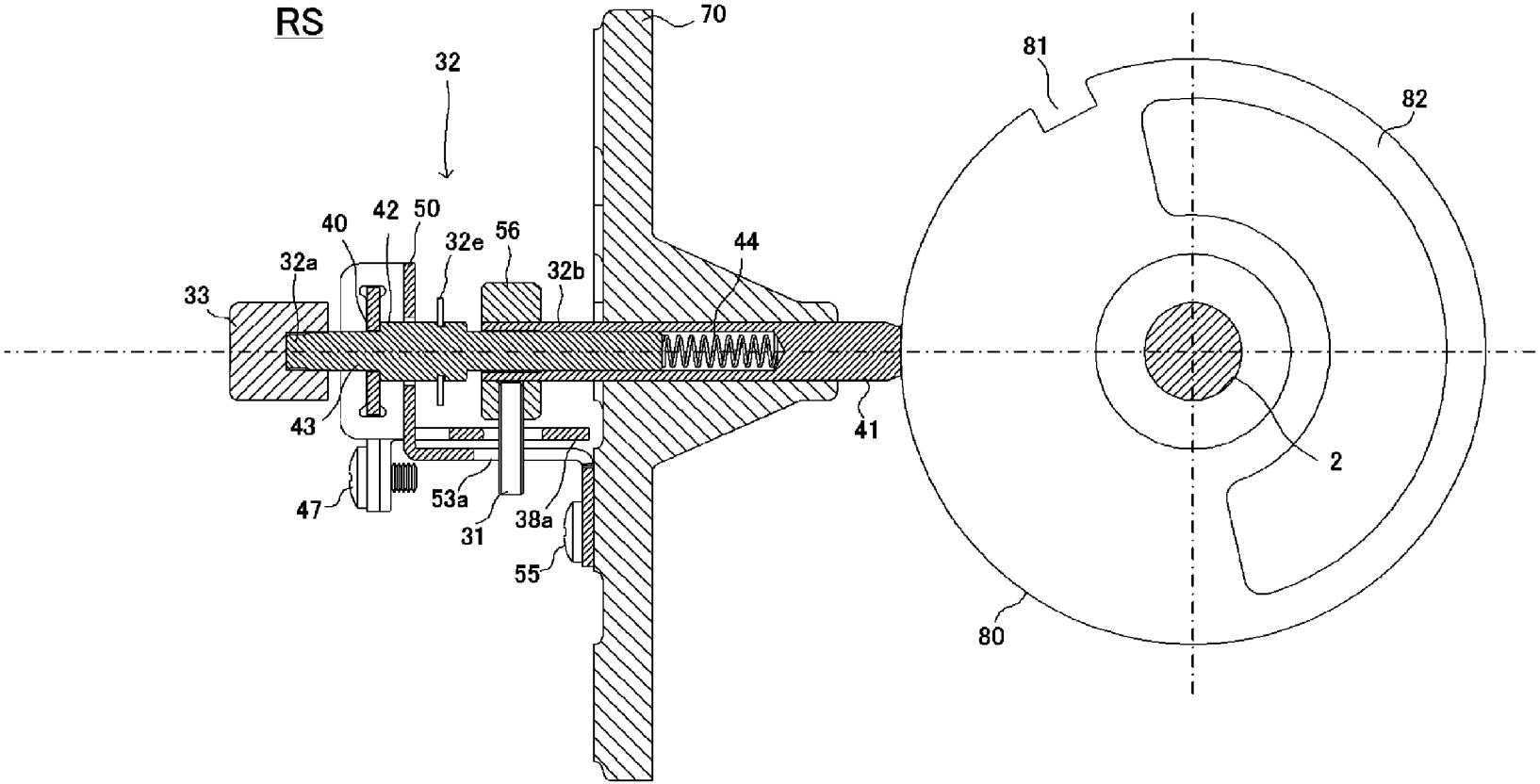
FIG. 7 A sectional explanatory view of the threading preparatory state cutting with a shaft line of a push button shaft in a gas carrying threading device of sewing machine by the present invention.

As shown in FIG. 7, in the threading preparatory state holding position RS, as for the set shaft 32*a* of the push button shaft 32, the large diameter portion 42 of the set shaft 32*a* is latched together at the one end of the slide portion 46 of the connecting movement plate 40, and the second control groove cam portion 35 of the control groove cam 38 engages at the stopper shaft control pin 31 which protrudes from the stopper shaft 32*b*. The stopper shaft 32*b* of the push button shaft 32 is held by contacting the tip portion 41 of the stopper shaft 32*b* to the peripheral surface 80 of the connecting positioning plate 82.

Figure 8:
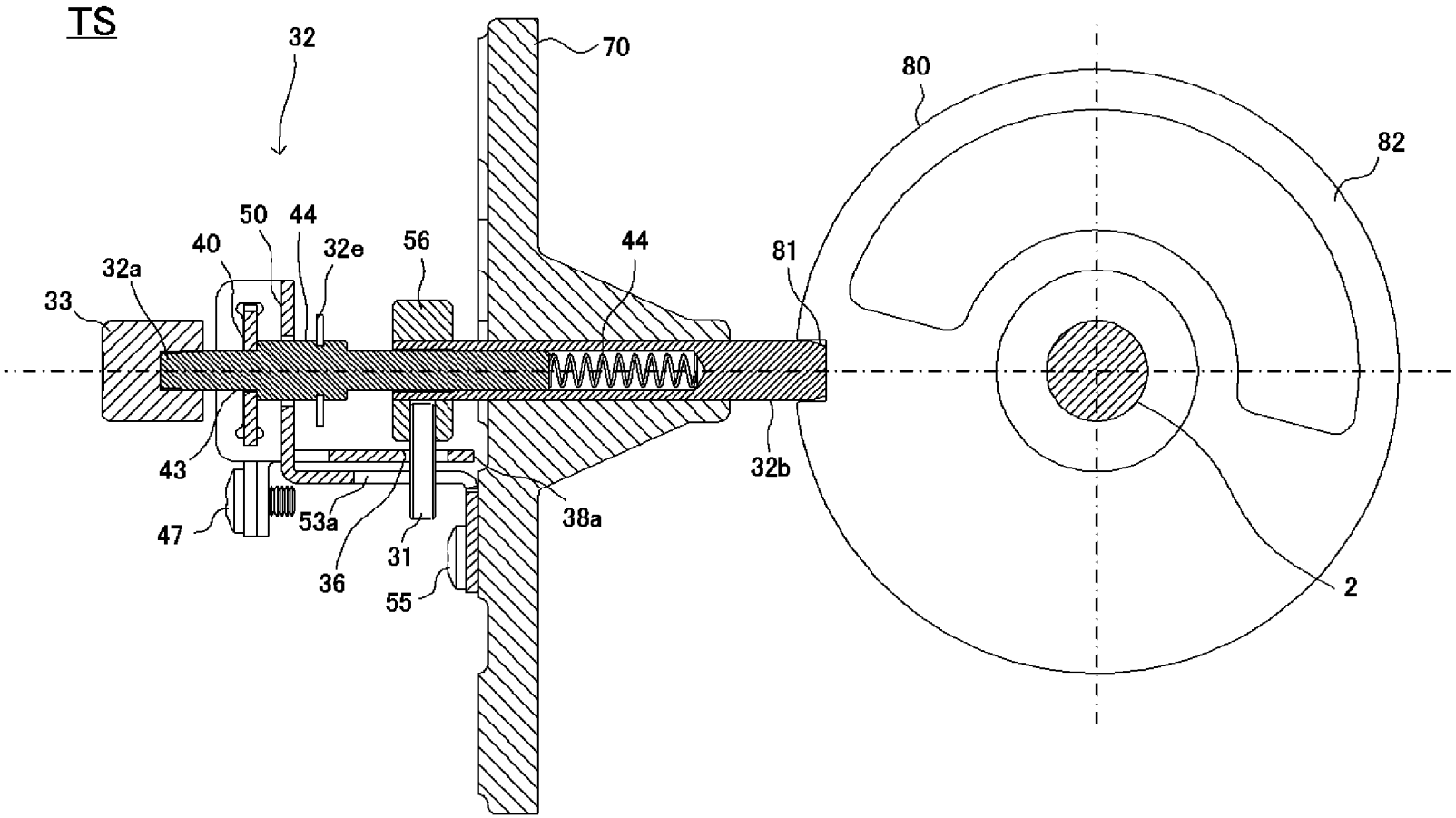
FIG. 8 A sectional explanatory view of the threading state cutting with a shaft line of a push button shaft in a gas carrying threading device of sewing machine by the present invention.

As shown in FIG. 8, in the threading state holding position TS, the set shaft 32*a* of the push button shaft 32 is held by latching together the small diameter portion 43 of the set shaft 32*a* at the one end of the slide portion 46 of the connecting movement plate 40, and the stopper shaft 32*b* of the push button shaft 32 is held by fitting the tip portion 41 of the stopper shaft 32*b* into the notch portion 81 of the connecting positioning plate 82.

In the gas carrying threading device of sewing machine of the present invention, after completing the threading to the upper looper 4 and the lower looper 5, when returning the connecting movement plate 40 from the threading state to the sewing state manually and forcibly, the return lever 48 that the stopper shaft control pin 31 slides in the fourth control groove cam portion 37 of the control groove cam 38 and latches together at the first control groove cam portion 34 and that the sewing state is held is provided at the intermediate portion of the connecting movement plate 40. The return lever 48 is bent from the connecting movement plate 40 toward the direction of the front side of the sewing machine, and protrudes together with the push button 33 from the cover which covers the front portion of the looper base 70.

In the control groove cam 38 of the gas carrying threading device of sewing machine of the present invention, the first control groove cam portion 34 that the stopper shaft control pin 31 is latched together at the time of the non-pressing operation of the push button 33 and that the sewing state (SS) is held continues to the fourth control groove cam portion 37 and the second control groove cam portion and has the U-shape groove cam structure.

The second control groove cam portion 35 that the stopper shaft control pin 31 is latched together at the time of the pressing operation of the push button 33 and the connecting movement plate is held in the threading preparatory state (RS) by contacting the tip portion 41 of the push button shaft 32 to the peripheral surface 80 of the connecting positioning plate 82 continues to the first control groove cam portion 34 and the third control groove cam portion 36 and has the step-like groove cam structure.

The third control groove cam portion 36 that the stopper shaft control pin 31 is latched together by rotating the main shaft 2 manually by the pulley P and the threading state (TS) is held by fitting the tip portion 41 of the push button shaft 32 into the notch portion 81 of the connecting positioning plate 82 continues to the second control groove cam portion 35 and the fourth control groove cam portion 37 and has the U-shape groove cam structure.

The fourth control groove cam portion 37 which returns the connecting movement plate 40 from the threading state to the sewing state manually and forcibly continues to the third control groove cam portion 36 and the first control groove cam portion 34 and has the slanted groove cam structure that the stopper shaft control pin 31 slides.

The cam plate 38*a* which is fastened by the screw 47 at the other end of the connecting movement plate 40 and moves integrally together with the connecting movement plate 40 has the control groove cam 38 which controls 4 (four) processes. The control groove cam 38 is composed by the first control groove cam portion 34 which controls the stopper shaft control pin 31 at the time of sewing, the second control groove cam portion 35 which controls the connecting movement plate 40 by contacting to the stopper shaft control pin 31 when the set shaft 32*a* is operated, the third control groove cam portion 36 for engaging the tip portion 41 of the stopper shaft 32*b* to the notch portion 81 of the connecting positioning plate 82 which is fastened at the main shaft by the screw 82*a* and moving the connecting movement plate 40 to the looper side and the fourth control groove cam portion 37 which controls the stopper shaft control pin 31 and releases the fixation of the main shaft 2 by pulling back the tip portion 41 of the stopper shaft 32*b* which engages to the notch portion 81 of the connecting positioning plate 82 and returns the push button shaft 32 to the initial state when the return lever 48 is operated after completion of the threading and the connecting movement plate 40 retreats and moves to the holding side.

Figure 2:
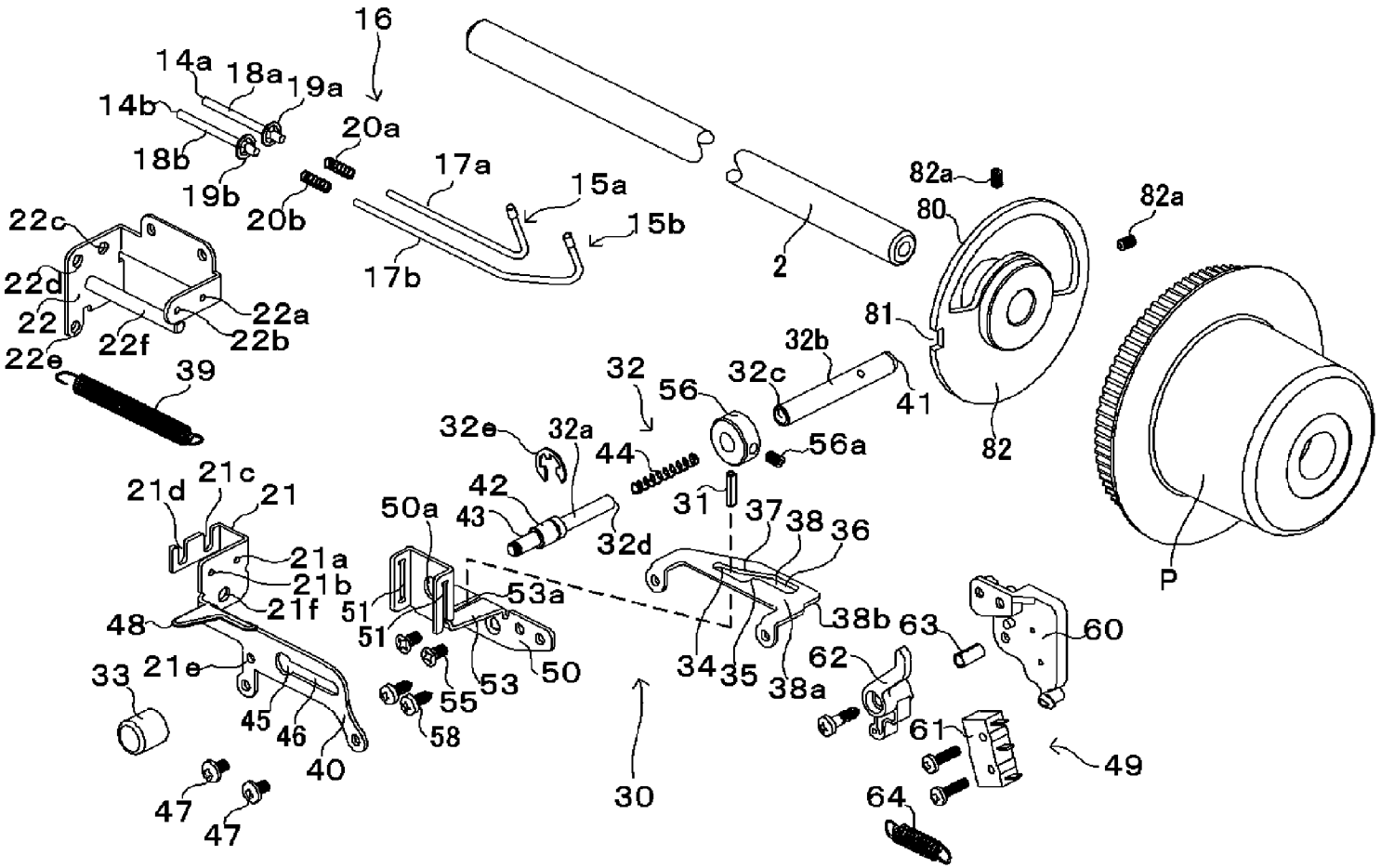
FIG. 2 An exploded perspective view of a gas carrying threading device of sewing machine by the present invention.

As shown in FIG. 1, FIG. 2 and FIG. 9, in the gas carrying threading device of sewing machine of the present invention, the safety device 49 which prohibits the power supply of the motor M which drives the main shaft 2 depending on the position of the connecting movement plate 40 is provided when the connecting movement plate 40 is held in the threading preparatory state (RS) and the threading state (TS) by the pressing operation of the push button 33. As the safety device 49, the safety switch pedestal 60 is fastened by the screw 58 at the right end portion of the fixed plate 54 which fastens the set shaft guide plate 50 at the looper base 70. The right end 38*b* of the outside of the cam plate 38*a* engages to the actuator 62 of the safety switch 61 which connects the power source of the sewing machine motor M when the connecting movement plate 40 is the holding state and disconnects the power source of the sewing machine motor M when the threading is operated. The safety switch 61 is fastened at the safety switch pedestal 60 which is fastened at the right end portion of the fixed plate 54 which is fastened at the looper base 70, and the actuator 62 is fitted loosely to the rotary shaft 63 of the safety switch pedestal 60, and the spring 64 is laid and fastened between the spring stud of the lower end of the actuator 62 and the spring stud of the lower end of the safety switch pedestal 60, and the connecting movement plate 40 moves from the holding position to the looper side, and concurrently the upper end of the actuator 62 which is engaged to the right end 38*b* of the cam plate 38 which is fastened at the connecting movement plate 40 and is pushed up rotates, and the safety switch 61 operates and the power source to the sewing machine motor M is disconnected. And thereby, when the threading is operated, the breakage of the sewing machine by the incorrect operation of such as the drive or the rotation of the sewing machine motor is prevented.

<The Gas Carrying Threading Device of Sewing Machine Seen from Other Viewpoint>

Besides, in one embodiment which sees the present invention from the other viewpoint, the gas carrying threading device of sewing machine of the present invention is provided with the upper looper 4 and the lower looper 5 which are the hollow structure (conduit=hollow pipe) from the looper thread inlet 13*a*, 13*b* to the looper loop-taker point thread outlet 8*a*, 8*b*, the thread introduction portion 12 which inserts the looper thread TH which is introduced to the upper looper 4 and the lower looper 5, the hollow thread guide portion (conduit=hollow pipe) 15*a*, 15*b* which is connected to thread introduction portion 12 and has the thread guide outlet 14*a*, 14*b* that the contact/separation is performed for the looper thread inlet 13*a*, 13*b* of the upper looper 4 and the lower looper 5, the connecting portion 16 which moves the thread guide portion (conduit=hollow pipe) 15*a*, 15*b* between the threading state that the thread guide outlet 14*a*, 14*b* of the thread guide portion 15*a*, 15*b* contacts to the looper thread inlet 13*a*, 13*b* of the upper looper 4 and the lower looper 5 and the sewing state that the thread guide outlet 14*a*, 14*b* of the thread guide portion 15*a*, 15*b* separates from the looper thread inlet 13*a*, 13*b* of the upper looper 4 and the lower looper 5, and the gas supply portion (air pump) 23 which feeds the looper thread TH from the thread introduction portion 12 to the looper loop-taker point thread outlet 8*a*, 8*b* through the upper looper 4 and the lower looper 5 when the thread guide portion 15*a*, 15*b* is moved to the threading state.

When moving the connecting portion 16 to contact and separate the thread guide outlet 14*a*, 14*b* of the thread guide portion 15*a*, 15*b* and the looper thread inlet 13*a*, 13*b* of the upper looper 4 and the lower looper 5 freely, the looper threading/sewing changeover mechanism 30 including the push button 33 for the pressing operation of the push button shaft 32 which protrudes the stopper shaft control pin 31, the control groove cam 38 including the plural control groove cam portions 34-37 which receive the stopper shaft control pin 31, the connecting movement plate 40 which supports the thread guide portion 15*a*, 15*b* and which is elastically repelled toward the threading state that the thread guide outlet 14*a*, 14*b* of the thread guide portion 15*a*, 15*b* contacts to the looper thread inlet 13*a*, 13*b* of the upper looper 4 and the lower looper 5 by the first spring 39, and the connecting positioning plate 82 which rotates together with the main shaft 2 integrally and has the peripheral surface 80 that the tip portion 41 of the push button shaft 32 contacts and has the notch portion 81 that the tip portion 41 of the push button shaft 32 is fitted is provided.

The control groove cam 38 of the looper threading/sewing changeover mechanism 30 has the first control groove cam portion 34 that the stopper shaft control pin 31 is engaged at the time of the non-pressing operation of the push button 33 and the sewing state is held, the second control groove cam portion 35 which is engaged at the stopper shaft control pin 31 at the time of the pressing operation of the push button 33 and holds the connecting movement plate 40 in the threading preparatory state by contacting the tip portion 41 of the push button shaft 32 to the peripheral surface 80 of the connecting positioning plate 82, the third control groove cam portion 36 that the stopper shaft control pin 31 is loosely fitted, the tip portion 41 of the push button shaft 32 is fitted into the notch portion 81 of the connecting positioning plate 82 by rotating the main shaft 2 manually and the threading state is held and the fourth control groove cam portion 37 that the stopper shaft control pin 31 slides and engages at the first control groove cam portion 34 when returning the connecting movement plate 40 from the threading state to the sewing state manually and forcibly after completing the threading to the upper looper 4 and the lower looper 5 and the sewing state is held.

According to this embodiment, as mentioned below, the gas carrying threading device of sewing machine of the present invention brings the operation similar to the embodiment described first.

Additionally, in another embodiment which sees the present invention from the other viewpoint, the gas carrying threading device of sewing machine of the present invention is provided with the upper looper 4 and the lower looper 5 which is the hollow structure (conduit=hollow pipe) from the looper thread inlet 13*a*, 13*b* to the looper loop-taker point thread outlet 8*a*, 8*b*, the thread introduction portion 12 which inserts the looper thread TH which is introduced to the upper looper 4 and the lower looper 5, the hollow thread guide portion (conduit=hollow pipe) 15*a*, 15*b* which is connected to the thread introduction portion 12 and has the thread guide outlet 14*a*, 14*b* which contacts to and separates from the looper thread inlet 13*a*, 13*b* of the upper looper 4 and the lower looper 5, the connecting portion 16 which moves the thread guide portion 15*a*, 15*b* between the threading state that the thread guide outlet 14*a*, 14*b* of the thread guide portion 15*a*, 15*b* contacts to the looper thread inlet 13*a*, 13*b* of the upper looper 4 and the lower looper 5 and the sewing state that the thread guide outlet 14*a*, 14*b* of the thread guide portion 15*a*, 15*b* separates from the looper thread inlet 13*a*, 13*b* of the upper looper 4 and the lower looper 5 and the gas supply portion (air pump) 23 which feeds the looper thread TH from the thread introduction portion 12 to the looper loop-taker point thread outlet 8*a*, 8*b* through the upper looper 4 and the lower looper 5 when the thread outlet portion 15*a*, 15*b* is moved to the threading state.

When moving the connecting portion 16 to contact and separate the thread guide outlet 14*a*, 14*b* of the thread guide portion 15*a*, 15*b* and the looper thread inlet 13*a*, 13*b* of the upper looper 4 and the lower looper 5 freely, the looper threading/sewing changeover mechanism 30 including the push button 33 for the pressing operation of the push button shaft 32 which protrudes the stopper shaft control pin 31, the control groove cam 38 including the plural control groove cam portions 34-37 which receive the stopper shaft control pin 31, the connecting movement plate 40 which supports the thread guide portion 15*a*, 15*b* and is elastically repelled toward the threading state that the thread guide outlet 14*a*, 14*b* of the thread guide portion 15*a*, 15*b* contacts to the looper thread inlet 13*a*, 13*b* of the upper looper 4 and the lower looper 5 by the first spring 39 and the connecting positioning plate 82 which rotates together with the main shaft 2 integrally and has the peripheral surface 80 that the tip portion 41 of the push button shaft 32 contacts and has the notch portion 81 that the tip portion 41 of the push button shaft 32 is fitted is provided.

The looper threading/sewing changeover mechanism 30 has the threading preparatory function (RS) which holds the connecting movement plate 40 from the sewing state to the threading preparatory state through the control groove cam 38 which engages to the stopper shaft control pin 31 by pressing the push button shaft 32 by the push button 33 and contacts the tip portion 41 of the push button shaft 32 to the peripheral surface 80 of the connecting positioning plate 82 which rotates together with the main shaft 2 integrally, the threading function (TS) which fits the tip portion 41 into the notch portion 81 of the connecting positioning plate 82 by rotating the main shaft 2 manually and holds the threading state and the return function which holds the sewing state through the control groove cam 38 which slides the stopper shaft control pin 31 when returning the connecting movement plate 40 from the threading state to the sewing state manually and forcibly after completing the threading to the upper looper 4 and the lower looper 5.

According to this embodiment, as mentioned below, the gas carrying threading device of sewing machine of the present invention brings the operation similar to the embodiment described first.

In the gas carrying threading device of sewing machine of the present invention which is composed in this way, the operation is performed as described below.

<Threading Preparation>

In the state that the sewing machine M is stopped and the serger 1 is in the non-sewing state, when the push button 33 of the looper threading/sewing changeover mechanism 30 is pushed at a finger-tip, the push button shaft 32 (set shaft 32*a*) advances. Thereby, the large diameter portion 42 of the set shaft 32*a* comes out of the holding portion (circular hole) 45 which is formed at the left end of the elongate hole of the connecting movement plate 40 and the small diameter portion 43 engages to the slide portion (elongate hole narrow slit) 46 of the connecting movement plate 40. The connecting movement plate 40 which is biased by the first spring 39 moves toward the looper side.

At the same time as the connecting movement plate 40 moves toward the looper side, the upper end of the actuator 62 of the safety device 49 which is pushed up by engaging to the right end 38*b* of the cam plate 38*a* which is fastened at the connecting movement plate 40 rotates, and the safety switch 61 is operated, and the power source to the sewing machine motor M is disconnected. Thereby, the breakage of the serger by such as incorrect operation to the motor controller MC at the time of the threading connecting state is prevented.

The push button shaft 32 (set shaft 32*a*) presses further the second spring (return spring) 44 which is installed in the inside of the connecting hole 32*c* of the stopper shaft 32*b* by fitting loosely the small diameter tip portion 32*d* into the connecting hole 32*c* which is drilled and provided at the stopper shaft 32*b*. When the small diameter portion 43 of the set shaft 32*a* engages to the slide portion (elongate hole narrow slit) 46 of the connecting movement plate 40, the large diameter portion 42 of the set shaft 32*a* contacts to the connecting movement plate 40 by the elastic repulsion of the second spring 44, and the return to the original position is prevented.

When the connecting movement plate 40 which is biased by the first spring 39 moves toward the looper side, the control groove cam 38 of the cam plate 38*a* which is fixed at the connecting movement plate 40 moves too. The control groove cam 38 of the cam plate 38*a* moves from the position of the first control groove cam portion 34 which controls at the time of the sewing, and thereby the second control groove cam portion 35 contacts to the stopper shaft control pin 31, and the stopper shaft control pin 31 stops the movement of the connecting movement plate 40. The connecting tube supporting portion 21 of the connecting movement plate 40 stops at the front that the tip of the movable thread guide portion 18*a*, 18*b* of the connecting portion 16 connects to the looper thread inlet 13*a*, 13*b*, and becomes the standby state.

When the set shaft 32 moves forward, the small diameter tip portion 32*d* further presses the second spring 44 which is installed in the inside of the connecting hole 32*c* of the stopper shaft 32*b*, and when the control groove cam 38 of the cam plate 38*a* moves from the position of the first control groove cam portion 34 which controls at the time of the sewing of the stopper shaft control pin 31, the tip 41 of the stopper shaft 32*b* contacts to the peripheral surface 80 of the connecting positioning plate 82 which is fastened at the main shaft 2, and the second control groove cam portion 35 contacts to the stopper shaft control pin 31 and stops the movement of the connecting movement plate 40.

In this way, the threading preparatory operation is completed only by one-touch operation to the push button 33.

<Performance of the Threading>

Next, when the main shaft 2 is rotated and driven by rotating the pulley by one hand, by the behavior of the upper and lower looper drive mechanism 3 (3*a*, 3*b*), the upper looper 4 performs the vertical motion by tracing the vertical ellipsoidal trajectory, and the lower looper 5 intersects with the trajectory of the needle which performs the vertical motion and swings, and the notch portion 81 of the connecting positioning plate 82 which is fastened at the main shaft 2 accords with the tip 41 of the stopper shaft 32*b* at the position that the position of the looper thread inlet 13*a*, 13*b* of the upper looper 4 and the lower looper 5 which work together respectively accords with the thread guide outlet 14*a*, 14*b* of the movable thread guide portion 18*a*, 18*b*.

When the notch portion 81 of the connecting positioning plate 82 accords with the tip 41 of the stopper shaft 32*b*, by the elastic repulsion force that the small diameter tip portion 32*d* of the set shaft 32*a* presses the second spring 44 which is installed in the inside of the connecting hole 32*c* of the stopper shaft 32*b*, the tip 41 of the stopper shaft 32*b* is inserted and engaged into the notch portion 81 of the connecting positioning plate 82 which is fastened at the main shaft 2, and the rotation of the main shaft 2 is stopped and fixed.

By the insertion and the engagement of the stopper shaft 32*b* to the notch portion 81 of the connecting positioning plate 82, the stopper shaft control pin 31 separates from the second control groove cam portion 35 of the control groove cam 38 which is formed at the cam plate 38*a* which contacts, and is fitted loosely into the third control groove cam portion 36.

When the stopper shaft control pin 31 separates from the second control groove cam portion 35 of the cam plate which contacts, the connecting movement plate 40 which stops in the standby state is released from the fixation, and the connecting movement plate 40 moves toward the looper side by the bias of the first spring 39, and advances the movable thread guide portion 18*a*, 18*b* which is supported at the supporting portion 21 through the guide plate 22, and the tip connects to the looper thread inlet 13*a*, 13*b*.

Thereby, the thread guide outlet 14*a*, 14*b* of the hollow thread guide portion 15*a*, 15*b* (the fixed thread guide portion 17*a*, 17*b*, the movable thread guide portion 18*a*, 18*b*) which is connected to the thread insertion opening 11*a*, 11*b* of the thread introduction portion 12 contacts to the looper thread inlet 13*a*, 13*b* of the upper looper 4 and the lower looper 5, and the looper loop-taker point thread outlet 8*a*, 8*b* becomes the connection state from the thread insertion opening 11*a*, 11*b* of the thread introduction portion 12.

In this connection state, thread take-up lever holes LTa, LTb of the looper take-up lever LT (FIG. 1, FIG. 3 (A), FIG. 3 (B) and FIG. 9) are intervened between the thread guide outlet 14*a*, 14*b* and the looper thread inlet 13*a*, 13*b*, and it is decided in the design preliminarily so that those thread pass centers accord.

The end portion of about 2 cm of the looper thread TH which is drawn out from the thread spool is inserted from the thread insertion opening 11*a*, 11*b* of the thread introduction portion 12 through a thread tensioner TA.

When the hand lever 24 is operated at the gas supply portion (air pump) 23, the compressed air is fed to the inside of the thread pass conduit of the thread guide portion 15*a*, 15*b*, and the looper thread TH is inhaled from the thread insertion opening 11*a*, 11*b* of the thread introduction portion 12 and discharged from the looper loop-taker point thread outlet 8*a*, 8*b* through the thread guide portion 15*a*, 15*b* (fixed thread guide portion 17*a*, 17*b*, movable thread guide portion 18*a*, 18*b*) through the conduit 10*a*, 10*b* of the upper looper 4 and the lower looper 5, and thereby the threading can be performed.

<Return to the Sewing State>

After the threading of the upper looper 4 and the lower looper 5 completes, the return lever 48 of the connecting movement plate 40 which protrudes from the elongate hole of the front cover of the looper base 70 is drawn back to the right direction of the pulley side by one hand.

When the return lever 48 is drawn back to the right direction of the pulley side, the connecting movement plate 40 retreats and moves to the direction of the pulley, and the tip of the movable thread guide portion 18*a*, 18*b* which is supported by the supporting portion 21 and guided by the guide plate 22 in the thread guide portion 15*a*, 15*b* separates from the looper thread inlet 13*a*, 13*b*.

When the connecting movement plate 40 retreats and moves to the direction of the pulley, the cam plate 38*a* which is fastened at this also moves, and the stopper shaft control pin 31 which is fitted loosely into the third control groove cam portion 36 slides in the fourth control groove cam portion 37, and the stopper shaft 32*b* is drawn back to the direction of the front side of the sewing machine by resisting the elastic repulsion of the second spring 44 which is installed in the inside of the connecting hole 32*c* of the stopper shaft 32*b*.

When the connecting movement plate 40 retreats and moves to the direction of the pulley, the connecting movement plate 40 moves from the slide portion (elongate hole narrow slit) 46 which is provided at the connecting movement plate 40 which engages with the small diameter portion 43 of the set shaft 32*a* of the push button shaft 32 to the holding portion (circular hole) 45 which penetrates the large diameter portion 42 of the set shaft 32*a* and holds the connecting movement plate 40.

When the connecting movement plate 40 moves and the holding portion (circular hole) 45 which holds the connecting movement plate 40 arrives at the center position of the set shaft, the stopper shaft control pin 31 which is controlled by the fourth control groove cam portion 37 retreats the stopper shaft 32*b*, and the small diameter tip portion 32*d* of the set shaft 32*a* is fitted loosely into the connecting hole 32*c* which is drilled at the stopper shaft 32*b* and further presses the second spring (return spring) 44 which is installed in the inside of the connecting hole 32*c* of the stopper shaft 32*b*. When the holding portion (circular hole) 45 which holds the connecting movement plate 40 arrives at the center position of the set shaft, the large diameter portion 42 of the set shaft 32*a* penetrates the holding portion (circular hole) 45, and pushes and returns the set shaft 32*a* of the push button shaft 32 to the direction of the front side of the sewing machine.

Further, when the connecting movement plate 40 moves toward the pulley side and arrives at the holding position, the upper end of the actuator 62 of the safety device 49 engages with the right end 38*b* of the cam plate 38*a*, and rotates the actuator 62, the safety switch 61 is operated and the power source to the sewing machine motor M is connected.

After the looper threading completes, the return lever 48 is operated, and thereby the thread guide outlet 14*a*, 14*b* of the thread guide portion 15*a*, 15*b* (fixed thread guide portion 17*a*, 17*b*, movable thread guide portion 18*a*, 18*b*) which connects at the connecting portion 16 and the looper thread inlet 13*a*, 13*b* of the conduit 10*a*, 10*b* of the upper looper 4 and the lower looper 5 returns to the non-connecting state, and the fixation of the main shaft 2 is also released, the power source to the sewing machine motor M is also connected, and the serger returns to the state that the sewing can be performed.

When the sewing machine motor M is rotated by the motor controller MC and the main shaft 2 is rotated and driven, by the operation of the upper and lower looper drive mechanism 3 (3*a*, 3*b*), the upper looper 4 performs the vertical motion by tracing the vertical ellipsoidal trajectory, and the lower looper 5 intersects with the trajectory of the needle which performs the vertical motion, and swings. And the sewing of the over-edge stitch can be performed by the stitch forming device which is composed by the needle which is driven by the needle drive mechanism 6, a presser foot mechanism which presses a cloth on a throat plate and a cloth feed mechanism 7 which forwards the cloth every one stitch.

In this way, according to the gas carrying threading device of sewing machine of the present invention, the looper threading can be performed with one-touch operation by one-handed three operations which are the threading preparatory operation, the threading positioning/the connecting pulley operation and the threading gas supply operation.

Therefore, according to the gas carrying threading device of sewing machine of the present invention, by connecting with the hollow thread guide portion which leads to the thread introducing part which inserts the looper thread from the thread outlet of the loop-taker point of the looper, the complicated thread guard is unnecessary and the threading that the handleability is easy can be performed. And, there are no mistake of the threading, no protrusion of the looper thread in mid-process, and no entanglement of the inserted looper thread with other thread. And because the looper thread is supplied by utilizing the flow of the pressurized gas which is supplied to the hollow thread guide portion, the threading can be performed with one-touch operation by the extremely easy operation.

Besides, according to the gas carrying threading device of sewing machine of the present invention, the breakage of the serger by such as incorrect operation to the motor controller during the threading preparatory operation and the completion of the threading can be prevented by disconnecting the power source to the sewing machine motor because the safety device works depending on the movement position of the connecting movement plate.

INDUSTRIAL APPLICABILITY

The gas carrying threading device of sewing machine in the present invention can be suitably applied to the chain stitch sewing machine such as the serger, the double chain stitch sewing machine, or the cover stitch sewing machine which insert the looper thread to the looper with one-touch operation by utilizing the pressurized gas.

EXPLANATION OF THE NUMERALS

2 main shaft
4 upper looper
5 lower looper
8*a*, 8*b* looper loop-taker point thread outlet
10*a*, 10*b* hollow structure (conduit=hollow pipe)
12 thread introduction portion
13*a*, 13*b* looper thread inlet
14*a*, 14*b* thread guide outlet
15*a*, 15*b* hollow thread guide portion (conduit=hollow pipe)
16 connecting portion
23 gas supply portion (air pump)
30 looper threading/sewing changeover mechanism
31 control pin (stopper shaft control pin)
32 push button shaft
32*a* set shaft
32*b* stopper shaft
32*e* contact retaining piece
33 push button
34 first control groove cam portion
35 second control groove cam portion
36 third control groove cam portion
37 fourth control groove cam portion
38 control groove cam
39 first spring
40 connecting movement plate
41 tip portion of the push button shaft
42 large diameter portion
43 small diameter portion
44 second spring
45 holding portion (circular hole)
46 slide portion (elongate hole narrow slit)
48 return lever
49 safety device
80 peripheral surface
81 notch portion
82 connecting positioning plate
TH looper thread
SS sewing state holding position
RS preparatory state holding position
TS threading state holding position

The invention claimed is:

1. A gas carrying threading device of sewing machine comprising:

at least one looper having a hollow structure from a looper thread inlet to a looper loop-taker point thread outlet, a thread introduction portion inserting a looper thread which is led to said looper, a hollow thread guide portion having a thread guide outlet which connects to said thread introduction portion and performs a contact/separation for said looper thread inlet of said looper, a connecting portion moving said thread guide portion between a threading state that said thread guide outlet of said thread guide portion contacts to said looper thread inlet of said looper and a sewing state that said thread guide outlet of said thread guide portion separates from said looper thread inlet of said looper, and a gas supply portion feeding said looper thread from said thread introduction portion to said looper loop-taker point thread outlet through said looper when said thread guide portion is moved to said threading state, further comprising, when moving said connecting portion to contact and separate said thread guide outlet of said thread guide portion and said looper thread inlet of said looper freely, a looper threading/sewing changeover mechanism including, a push button for a pressing operation of a push button shaft which protrudes a control pin, a control groove cam which includes a first control groove cam portion, a second control groove cam portion and a third control groove cam portion which receive said control pin, a connecting movement plate which supports said thread guide portion and which is elastically repelled toward said threading state that said thread guide outlet of said thread guide portion contacts to said looper thread inlet of said looper by a first spring, and a connecting positioning plate rotating together with a main shaft integrally and having a peripheral surface that a tip portion of said push button shaft contacts and having a notch portion that said tip portion of said push button shaft is fitted, said looper threading/sewing changeover mechanism comprising a sewing state holding position which latches together said control pin at said first control groove cam portion at the time of a non-pressing operation of said push button and holds said sewing state, a threading preparatory state holding position which latches together said control pin at said second control groove cam portion at the time of a pressing operation of said push button, contacts said tip portion of said push button shaft to a peripheral surface of said connecting positioning plate and holds said connecting movement plate in a threading preparatory state, and a threading state holding position which fits said tip portion of said push button shaft into said notch portion of said connecting positioning plate by rotating said main shaft manually, fits loosely said control pin into said third control groove cam portion and holds said threading state.

2. A gas carrying threading device of sewing machine according to claim 1, wherein:

said push button shaft includes said push button, and a set shaft which juxtaposes a large diameter portion and a small diameter portion and a stopper shaft which protrudes said control pin and includes said tip portion are connected in a nested state, and a second spring is intervened between both.

3. A gas carrying threading device of sewing machine according to claim 2, wherein:

said connecting movement plate has a holding portion and a slide portion which holds and slides a large diameter portion and a small diameter portion respectively which are juxtaposed at said set shaft, and is connected with said control groove cam which receives said control pin which is protruded from said stopper shaft so that both can move together freely.

4. A gas carrying threading device of sewing machine according to claim 2, wherein:

in said sewing state holding position, said set shaft of said push button shaft is held by latching together said large diameter portion of said set shaft in said holding portion of said connecting movement plate and contacting said contact retaining piece which is provided at said large diameter portion of said set shaft to said connecting movement plate by an elastic repulsion of said second spring, and said stopper shaft of said push button shaft is held by engaging said control pin which protrudes from said stopper shaft in said first control groove cam portion of said control groove cam, in said threading preparatory state holding position, said set shaft of said push button shaft is held by engaging said control pin which protrudes from said stopper shaft in said second control groove cam portion of said control groove cam, and said stopper shaft of said push button shaft is held by contacting said tip portion of said stopper shaft to a peripheral surface of said connecting positioning plate, in said threading state holding position, said set shaft of said push button shaft is held by latching together said small diameter portion of said set shaft at the one end of said slide portion of said connecting movement plate, and said stopper shaft of said push button shaft is held by fitting said tip portion of said stopper shaft into said notch portion of said connecting positioning plate.

5. A gas carrying threading device of sewing machine according to claim 1, wherein:

after completing a threading to said looper, when returning said connecting movement plate from said threading state to said sewing state manually and forcibly, said connecting movement plate has a return lever that said control pin slides in a fourth control groove cam portion of said control groove cam and latches together at said first control groove cam portion and holds said sewing state.

6. A gas carrying threading device of sewing machine according to claim 5, wherein:

in said control groove cam, said first control groove cam portion which latches together said control pin at the time of a non-pressing operation of said push button and holds said sewing state continues to said fourth control groove cam portion and said second control groove cam portion and has an U-shape groove cam structure, said second control groove cam portion which latches together said control pin at the time of a pressing operation of said push button and holds said connecting movement plate in the threading preparatory state by contacting said tip portion of said push button shaft to a peripheral surface of said connecting positioning plate continues to said first control groove cam portion and said third control groove cam portion and has a step-like groove cam structure, said third control groove cam portion which latches together said control pin by rotating said main shaft manually and holds said threading state by fitting said tip portion of said push button shaft into said notch portion of said connecting positioning plate continues to said second control groove cam portion and said fourth control groove cam portion and has an U-shape groove cam structure, and said fourth control groove cam portion which returns said connecting movement plate from said threading state to said sewing state manually and forcibly continues to said third control groove cam portion and said first control groove cam portion and has a slanted groove cam structure that said control pin slides.

7. A gas carrying threading device of sewing machine according to claim 1, wherein:

a safety device which prohibits the power supply of a motor which drives said main shaft depending on a position of said connecting movement plate is provided when said connecting movement plate is held in said threading preparatory state and said threading state by a pressing operation of said push button.

8. A gas carrying threading device of sewing machine comprising:

at least one looper having a hollow structure from a looper thread inlet to a looper loop-taker point thread outlet, a thread introduction portion inserting a looper thread which is led to said looper, a hollow thread guide portion having a thread guide outlet which connects to said thread introduction portion and performs a contact/separation for the looper thread inlet of said looper, a connecting portion moving said thread guide portion between a threading state that said thread guide outlet of said thread guide portion contacts to said looper thread inlet of said looper and a sewing state that said thread guide outlet of said thread guide portion separates from said looper thread inlet of said looper, and a gas supply portion feeding said looper thread from said thread introduction portion to said looper loop-taker point thread outlet through said looper when said thread guide portion is moved to said threading state, further comprising, when moving said connecting portion to contact and separate said thread guide outlet of said thread guide portion and said looper thread inlet of said looper freely, a looper threading/sewing changeover mechanism including, a push button for a pressing operation of a push button shaft which protrudes a control pin, a control groove cam which includes plural control groove cam portions which receive said control pin, a connecting movement plate which supports said thread guide portion and which is elastically repelled toward said threading state that said thread guide outlet of said thread guide portion contacts to said looper thread inlet of said looper by a first spring, and a connecting positioning plate rotating together with a main shaft integrally and having a peripheral surface that a tip portion of said push button shaft contacts and having a notch portion that said tip portion of said push button shaft is fitted, said control groove cam of said looper threading/sewing changeover mechanism comprising a first control groove cam portion which latches together said control pin at the time of a non-pressing operation of said push button and holds said sewing state, a second control groove cam portion which is latched together at said control pin at the time of a pressing operation of said push button and holds said connecting movement plate in a threading preparatory state by contacting said tip portion of said push button shaft to a peripheral surface of said connecting positioning plate, a third control groove cam portion that said control pin is loosely fitted by rotating said main shaft manually and holds said threading state by fitting said tip portion of said push button shaft into said notch portion of said connecting positioning plate, and a fourth control groove cam portion which slides said control pin and holds said sewing state by latching together at said first control groove cam portion when returning said connecting movement plate from said threading state to said sewing state manually and forcibly after completing a threading to said looper.

9. A gas carrying threading device of sewing machine comprising:

at least one looper having a hollow structure from a looper thread inlet to a looper loop-taker point thread outlet, a thread introduction portion inserting a looper thread which is led to said looper, a hollow thread guide portion having a thread guide outlet which connects to said thread introduction portion and performs a contact/separation for the looper thread inlet of said looper, a connecting portion moving said thread guide portion between a threading state that said thread guide outlet of said thread guide portion contacts to said looper thread inlet of said looper and a sewing state that said thread guide outlet of said thread guide portion separates from said looper thread inlet of said looper, and a gas supply portion feeding said looper thread from said thread introduction portion to said looper loop-taker point thread outlet through said looper when said thread guide portion is moved to said threading state, further comprising, when moving said connecting portion to contact and separate said thread guide outlet of said thread guide portion and said looper thread inlet of said looper freely, a looper threading/sewing changeover mechanism including, a push button for a pressing operation of a push button shaft which protrudes a control pin, a control groove cam which includes plural control groove cam portions which receive said control pin, a connecting movement plate which supports said thread guide portion and which is elastically repelled toward said threading state that said thread guide outlet of said thread guide portion contacts to said looper thread inlet of said looper by a first spring, and a connecting positioning plate which rotates together with a main shaft integrally and has a peripheral surface that a tip portion of said push button shaft contacts and has a notch portion that said tip portion of said push button shaft is fitted, said looper threading/sewing changeover mechanism comprising a threading preparatory function which holds said connecting movement plate from said sewing state to said threading preparatory state through a control groove cam which engages to said control pin by pressing said push button shaft by said push button and contacts said tip portion of said push button shaft to a peripheral surface of said connecting positioning plate which rotates together with said main shaft integrally, a threading function which fits said tip portion into said notch portion of said connecting positioning plate by rotating said main shaft manually and holds said threading state, and a return function which holds said sewing state through said control groove cam which slides at said control pin when returning said connecting movement plate from said threading state to said sewing state manually and forcibly after completing a threading to said looper.

10. A gas carrying threading device of sewing machine according to claim 3, wherein:

in said sewing state holding position, said set shaft of said push button shaft is held by latching together said large diameter portion of said set shaft in said holding portion of said connecting movement plate and contacting said contact retaining piece which is provided at said large diameter portion of said set shaft to said connecting movement plate by an elastic repulsion of said second spring, and said stopper shaft of said push button shaft is held by engaging said control pin which protrudes from said stopper shaft in said first control groove cam portion of said control groove cam, in said threading preparatory state holding position, said set shaft of said push button shaft is held by engaging said control pin which protrudes from said stopper shaft in said second control groove cam portion of said control groove cam, and said stopper shaft of said push button shaft is held by contacting said tip portion of said stopper shaft to a peripheral surface of said connecting positioning plate, in said threading state holding position, said set shaft of said push button shaft is held by latching together said small diameter portion of said set shaft at the one end of said slide portion of said connecting movement plate, and said stopper shaft of said push button shaft is held by fitting said tip portion of said stopper shaft into said notch portion of said connecting positioning plate.

* * * * *